US007086576B2

(12) United States Patent
Morrison

(10) Patent No.: US 7,086,576 B2
(45) Date of Patent: Aug. 8, 2006

(54) MACHINE FOR CONSTRUCTING THE SIDE WALL OF A CYLINDRICAL TANK

(75) Inventor: Alex J. Morrison, Edmonton (CA)

(73) Assignee: John Horton Mobile Tank Fabricators, Ltd., Edmonton (CA)

( * ) Notice: Subject to any disclaimer, the term of this patent is extended or adjusted under 35 U.S.C. 154(b) by 242 days.

(21) Appl. No.: 10/686,837

(22) Filed: Oct. 16, 2003

(65) Prior Publication Data

US 2004/0124226 A1 Jul. 1, 2004

(30) Foreign Application Priority Data

Oct. 25, 2002 (CA) ..... 2409798

(51) Int. Cl.

| | |
|---|---|
| ***B23K 20/12*** | (2006.01) |
| ***B23K 31/02*** | (2006.01) |
| ***B23Q 15/00*** | (2006.01) |
| ***B25B 27/14*** | (2006.01) |

(52) U.S. Cl. ..... 228/102; 228/103; 228/8; 228/9; 228/10; 228/12; 29/281.4

(58) Field of Classification Search ..... None
See application file for complete search history.

(56) References Cited

U.S. PATENT DOCUMENTS

| | | | | |
|---|---|---|---|---|
| 2,337,058 | A * | 12/1943 | McKee | 228/119 |
| 4,047,700 | A * | 9/1977 | Koller | 254/89 H |
| 4,494,291 | A * | 1/1985 | Morrison | 29/281.4 |
| 6,247,634 | B1 * | 6/2001 | Whitehouse | 228/112.1 |
| 6,266,862 | B1 * | 7/2001 | Oostwouder et al. | 29/281.4 |
| 6,381,977 | B1 * | 5/2002 | Austin, Jr. | 62/259.1 |

* cited by examiner

*Primary Examiner*—Lynne R. Edmondson
(74) *Attorney, Agent, or Firm*—Marsh Fischmann & Breyfogle LLP

(57) ABSTRACT

The machine is adapted to supply, manipulate and position steel strip, fed from a coil, so as to bring it into gapped relationship beneath the side wall of a partly constructed, elevated tank. This is done so that the strip can be welded to the side wall to add a course. It is the objective to ensure that the tank wall is plumb (vertical) and in radius (both as to curvature and relative to the center of the tank) and that the width of the gap is optimized, at the weld point. The machine comprises a 'floating' main frame or platform suspended on a mobile undercarriage by four pivotally mounted cylinders. The cylinders are independently responsive to instruments monitoring the elevation, levelness and plumbness of the tank wall and the width of the gap. The main frame carries the coil and carries the strip and the tank wall in the vicinity of the weld point. The instruments control the cylinders to vary the elevation, radius and attitude of the main frame to thereby achieve the objective and ensure desirable 'fit up' and gapping at the weld point.

8 Claims, 30 Drawing Sheets

MACHINE FOR CONSTRUCTING THE SIDE WALL OF A CYLINDRICAL TANK

BACKGROUND OF THE INVENTION

In my prior Canadian patent No. 1,153,878, I disclosed a machine and method (collectively a 'system') for constructing the side wall of a large cylindrical steel tank from a coil of steel strip. In general, this system involved:

building a circular steel floor for the tank on the ground, by welding together appropriately shaped flat plates;

building a circular roof on the floor by welding together a circumferential rolled channel rim, radial struts extending between a central sleeve and the rim, and plates supported by the struts;

raising the roof into the air with a circumferential array of lifting jacks and a central column extending through the sleeve;

tacking and then continuously welding a length of strip to the circular edge of the roof rim to establish the first course and initiate the downwardly extending side wall;

suspending the roof and side wall (now collectively referred to as "the tank") up in the air with the jacks holding the bottom rim of the wall;

positioning a steerable, powered, pneumatic wheel-supported machine on the tank floor adjacent the floor's side edge, the machine carrying a rotatable coil from which strip could be pulled or unwound;

advancing the machine along the circular edge of the floor while paying out strip from the coil. The paid-out strip was partly straightened by passing it through crush rolls to change its curvature to closely approximate that of the tank wall. The straightened strip was then guided and manipulated so that its top edge was aligned with the bottom edge of the first course in slightly gapped relationship at a "fit up and weld point" (hereinafter referred to as the "tack point"). A tack weld was then applied to join the wall and strip at this point. This process was repeated until a substantially complete second ring or course of strip had been tack welded to the tank wall. The end of the welded strip was then cut from the coil material. A continuous butt weld was thereafter applied along the horizontal wall/strip joint line, to complete joining the new ring of strip to the wall; and the structure was then further raised and the process repeated to add further courses to the wall of the developing tank. In this way the tank side wall was fully constructed and then welded to the floor to complete the structure.

The '878 machine was operated over a number of years in the construction of large oil storage tanks, using this method of unwinding coiled steel strip, partly straightening it, manipulating it into a gapped relationship with the tank wall at the tack point, and then tacking and butt welding it to the bottom rim of the suspended elevated tank wall.

However it was apparent throughout that there was need for a machine better able to manipulate and position the steel strip and the tank wall into optimum alignment, curvature, verticality or 'plumbness' and gapping, all at the tack point. This was not an easy problem to address, given:

that the strip approaches the tack point from the inside and at an angle;

that there are several factors which affect the outcome, such as the flabbiness and flexibility of the tank wall and strip, the unevenness of the floor on which the machine travels, changes in weight on the pneumatic tire-supported machine such as occur when steel is removed from the coil, and sagging of the side wall when the support of a jack, in the way of the machine, is removed; and that the gap width or spacing at the tack point has to be finely and accurately controlled with extreme precision. More particularly, one needs to be able to control the width of the gap, at the tack point, with an accuracy of about 0.01 inches (in the case of a 100' diameter tank having 2" tack welds at 8" centers). This is required because, if the desired gap at the cooled weld is to be 1/16", one needs to allow 0.01" extra for weld shrinkage (so the gap spacing at the tack point, prior to welding, should be 1/16"+0.01").

The present invention is the result of a far-reaching re-design of the machine and the steps practiced, to address these issues.

SUMMARY OF THE INVENTION

Before describing the invention in its various embodiments, it is useful to clarify the meaning of the words 'align, curvature, radius and plumb' for purposes of this specification. 'Align, aligned and alignment' are used herein for describing whether the adjacent edge portions of the tank wall and strip lie essentially in a common plane. 'Curvature' describes whether the wall and/or strip will form the desired cylindrical structure around the center of the tank. 'Radius' describes whether the machine or its components and the tank wall and strip are properly distanced relative to the center of the tank. 'Plumb or plumbness' is used in describing the verticality of the wall and/or strip.

The words are used without qualification in the disclosure and claims. However it is to be understood that alignment, curvature, radius and plumbness may not necessarily be perfectly achieved. Thus they are meant to mean substantial alignment, curvature, radius and plumbness.

In addition it is appropriate to clarify the meaning of the phrase 'tack point' as used herein. At this time the system has been developed to the extent that spaced tack welds are sequentially applied to attach a new course to the tank wall and then a continuous butt weld is applied to complete the attachment. However it is anticipated that only a single root weld, continuous in nature, can be applied. The phrase 'tack point' is therefore to be understood to mean the location where the weld is being applied, whether it is a tack weld or a continuous root weld.

The verb 'monitor', as used herein, is intended to mean establishing, on an on-going basis, measurements of a parameter such as plumbness or gap width.

And finally, the word 'mechanically' is used herein to qualify the verb 'monitoring' and is intended to encompass using any mechanical, electrical, optical, magnetic or other instrument for establishing measurements of a parameter such as plumbness or width.

It needs to be kept in mind that, if the roof is carefully constructed to have a cylindrical rim, then the first course attached to it should be cylindrical and vertical, if the roof is horizontal. The trick then, is to continue adding courses in such a manner that a cylindrical and plumb side wall is gradually constructed.

To achieve a proper 'fit up' at the tack point then, one wants:

the bottom edge of the tank wall to be horizontal or level (that is, 'in plane') and at a desired elevation;

the tank wall to be plumb or vertical;

the tank wall and strip should also both conform with regard to the required curvature;

they should lie in a common plane and have their adjacent edges aligned; and the gap spacing should be optimized precisely to the width required for the cooled weld plus an extra amount needed to allow for the inevitable shrinkage of the weld upon cooling.

The objective of this invention is to provide a machine and method better able to deliver a proper fit up at the tack point.

I have noted that the tack point gap between the adjacent edges or rims of the tank wall and strip, extending forwardly from the last tack weld, is not in a straight line plane. The strip is attached to the tank wall at the last tack weld and is hinged thereto. The strip and wall are each curved. In addition, the strip curves inwardly toward the coil. I refer to the gap configuration prior to the tack point as being "parabolic" in nature.

While working with tank wall and strip in this described configuration, I have discovered that the width of the gap at the tack point can be finely narrowed or widened by changing the plumbness of the strip by moving its bottom edge through a relatively large or coarse radial travel.

From this starting point I have evolved one method embodiment of the invention which comprises:

monitoring the plumbness , elevation and levelness of the tank wall;

responsive to such monitoring, manipulating and positioning the tank wall so that it is plumb, at a desired elevation and in plane at the tack point;

supplying, manipulating and positioning the strip so that it aligns with and assumes the curvature of the wall at the tack point, with the strip and wall edges being separated to provide a gap, at the tack point, that is close to being optimum for welding;

monitoring the width of the gap to determine any error relative to a pre-determined optimum gap width at the tack point;

holding and supporting the strip at its bottom edge with radially movable strip carrier means; and moving the strip carrier means and the bottom of the strip radially through a relatively coarse travel (for example, 1"), in response to the gap measurement, as required to adjust the gap width at the tack point by a relatively fine amount (controllable to thousandths of an inch) to bring that gap width toward a pre-determined optimum width (say 1/16"+0.01").

Following is my explanation as to why a coarse radial adjustment at the base of the strip results in a minute variation in the width of the gap at the tack point. Visualize the vertically standing strip as a vertical lever 72 inches long (which is the width of the strip I use). When a 100 foot diameter, vertically walled tank is involved, the tangent offset in 60" of horizontal length is 1 inch. Movement on the 72 inch bottom end of the vertical lever is 72 times the movement of the top end of the lever. Therefore radial movement (for example, in or out 1 inch) at the bottom of the strip, 60" ahead of the tack point, results in movement at the top of 1/72 inch. This 1/72 of an inch variation applies to a point 60 inches ahead of the last tack weld, as my machine is set up. The tack point is 6 inches from the last tack, or 1/10 of the overall distance (assuming a 2" tack on 8" centers). Therefore the change in gap width at the tack point will be 1/10 of 1/72 (that is, 0.0138) of an inch, or 0.00138 of an inch, when movement of 1 inch off plumb is implemented 60" ahead of the last weld point at the lower edge of the strip. As a result, remarkably fine adjustment of the gap width or spacing can be attained, allowing one to control gap width with the precision needed to compensate for tack weld shrinkage.

I have therefore conceived and applied the scheme of adjusting the plumbness of the strip by radially altering the location of its bottom edge through a 'coarse travel' or movement, to cause a resultant and predictable, very fine closing or opening of the gap at the top edge of the strip at the tack point. This has led to being able to use a relatively imprecise hydraulic cylinder to vary strip plumbness to attain minute and accurate gap spacing variation at the tack point. When this is coupled with appropriate gap spacing measurements, one can consistently produce accurate, fine gap spacing control at the tack point.

In a preferred extension of this embodiment, the method further comprises:

externally backing the wall and strip above and below the weld joint in the vicinity of the tack point with an arcuate fitting frame conforming to the tank wall curvature; and internally pressing the wall and strip against the fitting frame, to bring them into corresponding alignment, curvature and plumbness at the tack point, ready for welding.

In other words, using this method I can substantially accomplish the following:

establishing verticality and levelness of the tank wall;

providing a plumb, properly curved fitting frame backing the strip and tank wall prior to the tack point with the result that the strip lays against the fitting frame and aligns with the tank wall;

establishing a measurement of the width of the gap between the aligned edges at the tack point;

responsive to the measurement, radially moving the bottom of the strip to vary the plumbness of the strip and thereby finely open or close the gap spacing at the tack point, as required to achieve optimum gap width; and pressing the strip and wall adjacent the tack point against the fitting frame to fix the desired plumbness, curvature and alignment at the location where the weld is to be applied.

In a further preferred extension of this embodiment, the method comprises:

adjusting the orientation of the coil to maintain the strip at a desired angularity adapted to yield a gap width at the tack point that is optimum or close to it.

In this preferred embodiment, adjustment of the coil orientation is used to establish gap width at the tack point on a 'coarse' basis and radial adjustment of the bottom of the strip is used to vary the gap width on a 'fine' basis , if required, to correct minute deviation from a desired optimum.

In one broadly stated aspect of the invention, a method is provided for finely adjusting, at a tack point, the width of a gap between a bottom edge of a steel side wall of an elevated cylindrical tank and a top edge of a steel strip being fed from a coil being conveyed by a machine moving circularly within the tank, said edges forming a joint line, the strip already having been welded along part of its length to the tank wall along the joint line behind the tack point, comprising: mechanically monitoring the plumbness, elevation and levelness of the tank wall; responsive to such monitoring, manipulating and positioning the tank wall so that it is plumb and in plane at a pre-determined elevation at the tack point; supplying, manipulating and positioning the strip so that it aligns with and assumes the curvature of the tank wall at the tack point, with the strip and wall edges being separated to provide the gap at the tack point; monitoring the width of the gap; and, responsive to such gap width monitoring, radially moving the bottom of the strip as required to thereby adjust the plumbness of the strip and effect an adjustment of the gap width at the tack point to bring it to a pre-determined optimum width for welding.

In another aspect of the invention, I have developed a machine for constructing the cylindrical side wall of a tank. In one embodiment, this machine comprises the combination of:

a generally horizontal main frame;

preferably wheeled and steerable undercarriage means for conveying the main frame along the tank floor and positioning it adjacent the floor's circular peripheral edge;

turntable means, mounted on the main frame, for rotatably carrying a coil of steel strip and dispensing strip therefrom;

means, mounted on the main frame, for straightening the strip to a desirable curvature, which may reach flatness;

means, preferably a plurality of separately controlled cylinders, pivotally connected with the undercarriage means and the main frame. The cylinder means suspend the main frame in a controlled 'floating' condition. That is, the cylinder means are operative to shift the main frame from side to side, raise or lower it, tilt it to one side or the other and tilt it forward or backward. Otherwise stated, the cylinder means can alter the radius, attitude and elevation of the main frame, the coil mounted on it, the strip issuing from the coil, and other components connected with it;

strip carrier means, connected with the main frame for movement in concert therewith, operative to hold and support the bottom of the strip, preferably ahead of the tack point. The strip carrier means preferably holds the strip substantially perpendicular to the plane of the main frame;

a fitting frame assembly, connected with the main frame for movement in concert therewith. The fitting frame assembly includes a curved fitting frame which conforms to the ultimately desired wall curvature. Preferably this assembly is mounted to the rear outer corner of the main frame. The undercarriage means and the main frame are adjusted to locate the fitting frame externally of the tank wall and 'in radius'. The fitting frame functions to externally engage or support both the wall and strip, above and below the joint line, ahead of the tack point, to provide a backing or anvil against which the wall and strip lay and are pressed to align their edges and ensure that the strip and wall at the tack point assume a verticality dictated by the main frame positioning and a curvature dictated by the curvature of the fitting frame; and means for pressing the strip and wall edge portions in the vicinity of the tack point against the fitting frame to cause them to conform with respect to alignment, curvature and plumbness at the tack point.

It is relatively simple to initially set up so that:

the tank wall is vertical and its bottom edge is in plane; and to provide a coil with properly straightened strip converging to the tack point at an angle operative to provide substantially optimum gap width.

However, changing conditions arise as one advances from the original set up and commences applying welds at sequential tack points. These changes (tank wall sagging, irregular floor, changes of weight on the machine, etc.) affect tank wall verticality, curvature and levelness, strip angularity and gap width.

For these reasons, the machine is provided with the capabilities:

to monitor the tank wall's plumbness and elevation and to adjust same in response to such monitoring; and to manipulate and position the strip, in response to gap width measurements, to achieve an optimum gap width.

In another broadly stated aspect, the invention is concerned with a machine for supplying, manipulating and positioning steel strip to locate the strip's upper edge in spaced relationship below the lower edge of an elevated cylindrical tank wall, to which the strip is already welded along part of its length, to form a gap, at a joint line and at a tack point, which gap has a width substantially optimal for welding of the strip to the wall, comprising: a generally horizontal main frame; first means for conveying the main frame and positioning it; second means, supporting the main frame on the conveying means, for separately adjusting the elevation, attitude and radius of the main frame at the tack point; third means for carrying a coil of steel strip on the main frame and dispensing and straightening strip so that it substantially conforms with the curvature of the tank wall; and fourth means, connected with the main frame, for supporting and holding the straightened strip at its lower edge, so that the strip is substantially upright relative to the main frame; whereby the attitude, elevation and radius of the main frame may be adjusted to vary the width of the gap between the tank wall and strip at the tack point.

DESCRIPTION OF THE DRAWINGS

Due to the difficulty of showing all of the components on one Figure, the Figures are presented showing some components but omitting others.

DESCRIPTION OF THE PREFERRED EMBODIMENT

Figure 1:
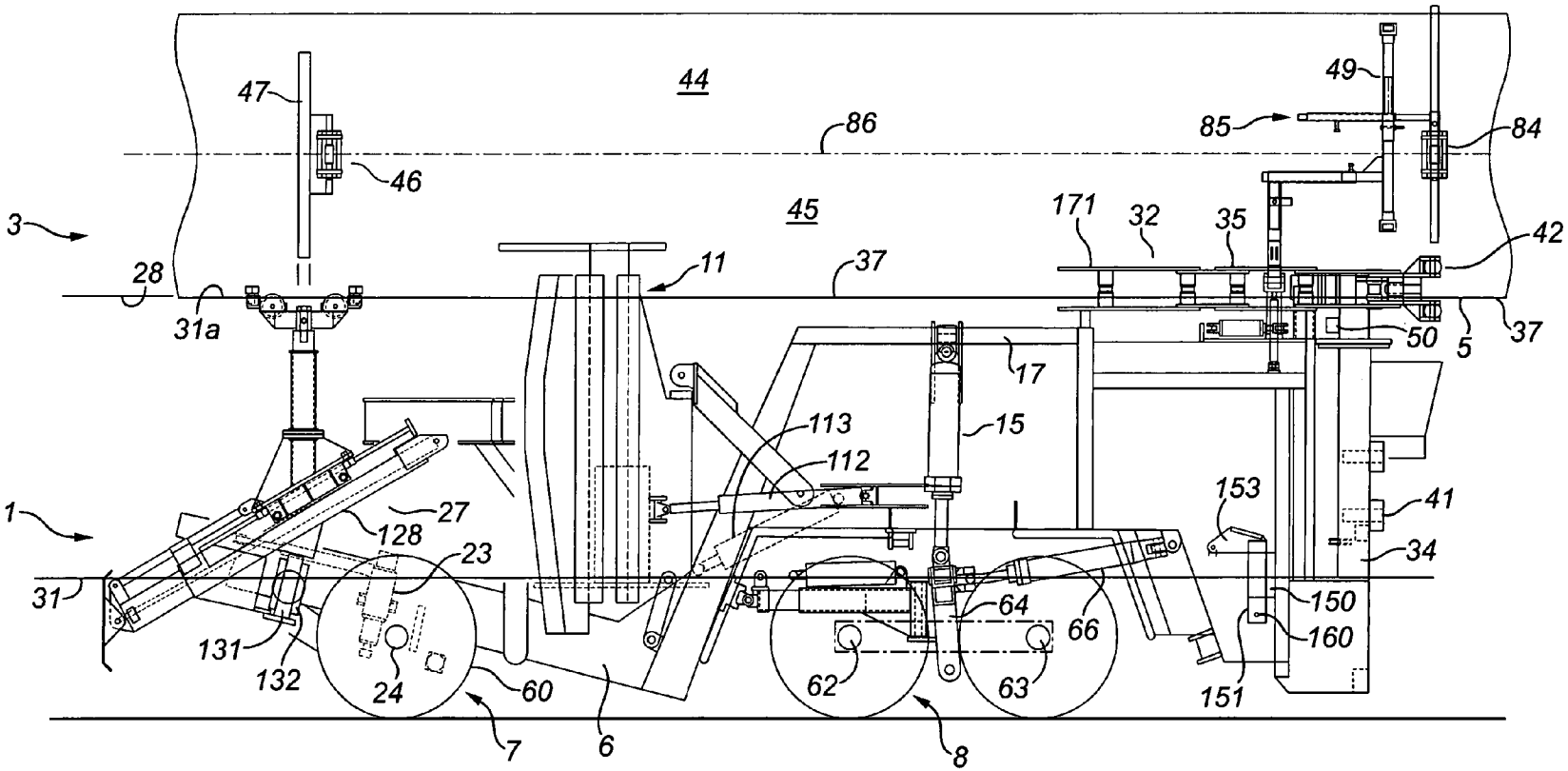
FIG. 1 is a side elevation showing the tank machine.

The invention is concerned with a machine 1 adapted to fit a strip 2 of steel to the side wall 3 of a partially formed, elevated, cylindrical tank 4 at a weld or tack point 5. The invention also is concerned with a process which the machine 1 practices in the course of its operation. The machine I incorporates a combination of component assemblies, some of which are claimed as sub-combinations. Similarly, the method incorporates a combination of steps, some of which are claimed as sub-combinations.

General Outline

Turning firstly to the machine 1, in general it includes:

- a unitary, rigid, generally horizontal main frame 6 which carries and combines with the component assemblies to supply the strip 2 and manipulate the strip and the tank wall 3 to provide proper fit-up at the tack point 5;
- steerable driven front and rear wheeled undercarriage assemblies 7, 8 which carry the main frame 6. The undercarriage assemblies 7, 8 collectively provide a means for conveying and positioning the main frame 6;
- a turntable assembly 9, mounted on the main frame 6, for rotatably carrying a coil 10 from which strip 2 is dispensed;
- a straightening assembly 11, mounted on the main frame 6, for partly straightening the strip 2, as it leaves the coil 10, to conform it substantially to the curvature of the tank wall 3;
- a support cross beam 12 mounted on the rear undercarriage assembly 8. This cross beam 12 forms part of the assembly 8 and is a radially fixed platform, tethered to a fixed post 13 at the center of the tank 4 by a rigid radius beam 14. The main frame 6 is pivotally mounted on the cross beam 12 and the front undercarriage assembly 7 by cylinders described below;
- a set of four cylinders for collectively adjusting the elevation, radius and attitude of the main frame 6 relative to the supporting undercarriage assemblies 7, 8. More particularly, there is provided a pair of upright cylinders 15, 16 which extend between the horizontal cross beam 12 and two side beams 17 forming part of the main frame 6. These cylinders 15, 16 are connected with the cross beam 12 and main frame side beams 17 by universally pivoting connections 18. The outer cylinder 15 (relative to the center of the tank 4) is referred to as the 'elevation cylinder' and functions independently to raise and lower the main frame 6. The inner cylinder 16 is referred to as the 'level cylinder' and functions independently to adjust the side to side levelness of the main frame 6. A third cylinder 19, referred to as the 'side shift cylinder', is pivotally connected with the inner end 20 of the cross beam 12 and the outer underside 21 of the main frame 6 by universally pivoting connections 22. The side shift cylinder 19 independently functions to move the main frame 6 in or out radially. A fourth cylinder 23, referred to as the 'front off-level cylinder', is connected between the axle 24 of the front undercarriage assembly 7 and the main frame 6 through a pivoting link assembly 25. The front off-level cylinder 23 independently functions to raise or lower the front end 26 of the main frame 6, thereby changing the orientation of the coil 10 to change the angle of convergence of the strip 2 prior to the tack point 5, thereby varying the width of the gap. The cylinders 15, 16, 19, 23 collectively function to manipulate the 'floating' main frame 6 to adjust its elevation, radius and attitude, thereby manipulating and positioning the tank wall 3 and strip 2, as required;
- a forward carrier roller assembly 27, carried by the main frame 6. The assembly 27 holds and supports the bottom edge 28 of the erected tank wall 3. The assembly 27 is located about 20 feet ahead of the tack point 5. It is vertically and radially adjustable. It functions to adjust the elevation, radius and plumbness of the tank wall 3, mainly to offset sagging of the tank wall 3 when one or two jacks 29 in the path of the machine 1 are disengaged;
- a rear carrier roller assembly 30, connected to the main frame 6, which holds and supports the bottom edge 31 of the strip 2. The assembly 30 also functions to guide the strip 2 into the fitting frame assembly 32. The assembly 30 holds the strip 2 at 90° relative to the plane of the main frame 6. Since the rear carrier roller assembly 30 moves with the main frame 6, when the levelness or side-to-side attitude of the main frame 6 changes, the assembly 30 adjusts the plumbness of the hinged strip 2;
- a fitting frame assembly 32 mounted on the outside rear corner 33 of the main frame 6. This assembly 32 comprises a vertical post 34, secured to the corner 33, to which is disengagably locked an arcuate fitting frame 35. The post 34 and fitting frame 35 can be positioned externally of the tank wall 3 by suitable maneuvering of the undercarriage assemblies 7, 8. The fitting frame 35 bridges the gap 36 at the joint line 37 between the tank wall 3 and the strip 2. It provides a plumb, curved 'anvil' or backstop against which the adjacent edge portions 38, 39 of the tank wall 3 and strip 2 will lay, in the vicinity of the tack point 5, to thereby cause alignment of the respective edges 28, 31 and conform the edge portions 38, 39 in curvature and plumbness to that of the fitting frame 35. This enables one to measure the gap 36 with the tank wall 3 and strip 2 aligned. The fitting frame assembly 32 also functions to assist in guiding the strip 2 to the tack point 5;

an inside push-out assembly 40 positioned internally of the strip 2 at about its mid-line and ahead of the fitting frame assembly 32. The push-out assembly 40 has a roller 193 that can be biased outwardly to apply outward force to the strip 2. The assembly 40 functions to guide the strip 2 to the fitting frame 32, to prevent inward bulging of the strip and to bow the usually quite straight strip so that it tends to assume the curvature of the tank wall 3;

an inside back-up tandem roller assembly 53 mounted to the main frame 6, opposite the forward end of the fitting frame 35. The assembly 53 bridges the joint 37 and can be biased outwardly to press the tank wall and strip edge portions 38, 39 from the inside against the external fitting frame 35, ahead of the tack point 5. It therefore functions to align the wall and strip edges 28, 31 and conforms their edge portions 38, 39 in the vicinity of the tack point 5 with respect to curvature and plumbness;

a strip feed roll assembly 41 mounted to the main frame 6, downstream of the inside back-up tandem roller assembly 53. The assembly 41 functions to positively pull strip 2 from the coil 10 and to assist in guiding it to the tack point 5. It overcomes the resistance created by the upstream rollers;

a hi-lo roller assembly 42 mounted to the main frame 6 and located immediately downstream of the rear end of the fitting frame assembly 32. The assembly 42 has rollers which bracket the joint 37 and can press against the tank wall and strip edge portions 38, 39, both internally and externally, adjacent the tack point 5. The hi-lo roller assembly 42 functions to correct plate misalignment adjacent the tack point 5 (the tank wall 3 and strip 2 can be considered to be 'plates' at the tack point, as that term is understood in the art);

a laser broadcaster 43 positioned at the center of the tank 4 at an elevated position. The broadcaster 43 functions to produce a level infra-red beam, for interacting with the machine control receivers described below, and a visible light appearing as a ring on the inside surface 44 of the last course 45 of the tank wall 3. This beam should register with a chalk line 86 or reference marker ring scribed in advance on the tank wall surface 44. If the ring and chalk line fail to register, the elevation and/or levelness of the tank wall requires correction;

a forward carrier laser sensor receiver 46 mounted to the main frame 6 at the forward end of the machine 1. The receiver 46 is positioned to straddle the reference chalk line 86. It is activated by the laser beam and actuates the forward carrier roller assembly 27 to adjust the elevation of the tank wall 3;

a rear carrier laser sensor receiver 84 mounted to the main frame 6 directly above the tack point 5. The receiver 84 straddles the reference chalk line 86. It is activated by the laser beam and actuates the elevation cylinder 15 to adjust the elevations of the tank wall bottom edge 28 and strip top edge 31*a* to bring them to a pre-determined desired spacing relative to the chalk line 86;

an adjustable vertical inclinometer assembly 47, mounted to the main frame 6, which bears against the inside surface 44 of the tank wall 3 at the forward end of the machine 1. The inclinometer assembly 47 will have been pre-set to maintain a desired plumbness of the tank wall 3. The inclinometer assembly 47 monitors the plumbness of the tank wall 3 and controls the swing cylinder 132, which can bias the forward carrier roller assembly 27 radially, to adjust the radius and plumbness of the forward tank wall 3;

an adjustable vertical inclinometer assembly 49, mounted to the main frame 6, which bears against the inside surface 44 of the tank wall 3 at the rear of the machine at about the tack point 5. The inclinometer assembly 49 will have been pre-set to maintain a desired plumbness of the tank wall 3 at the tack point 5. The inclinometer assembly 49 monitors the plumbness of the tank wall 3 and controls the side shift cylinder 19 to vary the radius of the main frame 6 at the back end and thereby adjust the plumbness of the tank wall 3 to maintain it at the desired value. The main frame 6 carries the strip 2, which is joined to the tank wall 3 by previous welds. Therefore radial movement of the main frame 6 is transmitted to the tank wall 3 through the strip 2. In addition, radial movement of the main frame 6 causes adjustment of the tank wall plumbness because the inside back-up tandem roller assembly 53 (pressing against the tank wall 3 and strip 2 from the inside) and the fitting frame assembly 32 (pressing against the tank wall 3 and strip 2 from the outside) both move with the main frame 6;

an adjustable horizontal level inclinometer assembly 50 mounted on the main frame 6. The inclinometer assembly 50 will have been pre-set, in response to measurement of the gap width, to maintain a certain mainframe levelness or attitude. More particularly, the inclinometer assembly 50 monitors main frame side to side levelness and controls the level cylinder 16 to bring the level of the main frame 6 to the pre-set value. This establishes the plumbness of the strip 2 and determines the precise width of the gap 36 along its length and, in particular, at the gap measuring point 60" ahead of the tack point 5. Otherwise stated, the width of the gap 36 is monitored, the inclinometer assembly 50 is set in response thereto, and the assembly 50 thereafter controls the level cylinder 16 to maintain the levelness or attitude of the main frame 6 at the set value. As a result, the bottom of the strip 2 is moved in or out radially, thereby varying the plumbness of the strip 2 and maintaining the width of the gap 36 at the tack point 5 at the optimum value; and an adjustable horizontal front-to-back inclinometer assembly 51 mounted to the main frame 6. The inclinometer assembly 51 will have been pre-set to maintain a desired front-to-back angularity of the main frame 6. The assembly 51 monitors the main frame's front to back attitude and controls the front off-level cylinder 23 to maintain the main frame's angularity at the desired value. This controls the orientation of the coil 10, so that the strip 2 is fed to the tack point 5 at a desired angle of convergence, to thereby maintain the width of the gap 36 at a desired value.

The width of the gap 36 can be monitored manually using a feeler gauge. I take such measurements 5 feet ahead of the tack point 5. I have established correlations between the gap width at the measurement point and the gap width at the tack point 5. Alternatively, a feeler gauge or blade having a thickness corresponding with the desired gap width can be rotatably mounted so as to extend into the gap 36. A horizontal lever is attached at 90° to the blade. Movement of the lever activates a micro-switch which in turn controls the valve actuating the front off-level cylinder 23.

In summary then, there is provided:

a main frame;

means for conveying the main frame and positioning it as required;

a coil carried by the main frame, for paying out strip;

means, carried by the main frame, for straightening the strip to substantially conform it with the curvature of the tank wall;

means, connected with the main frame, for holding the strip at its bottom edge to maintain the strip at a pre-determined angle relative to the main frame;

forward carrier means, connected with the main frame, for holding the tank wall at its bottom edge at the front end of the machine 1 and separately adjusting its elevation and radius, as required;

forward end of the machine and activating the forward carrier means to correct deviations;

means, suspending the main frame on the conveying means, for separately adjusting the elevation, radius and attitude of the main frame to thereby adjust the plumbness and elevation of the tank wall at the tack point and the convergence angle and plumbness of the strip , also at the tack point, to enable proper fit-up for optimum welding;

means for monitoring the front-to-back angularity of the main frame and activating the main frame adjusting means to correct a deviation from a pre-determined angularity;

means for monitoring the plumbness of the tank wall adjacent the tack point and activating the main frame adjusting means to correct a deviation from vertical;

means for monitoring the elevation of the tank wall adjacent the tack point and activating the main frame adjusting means to correct deviation and position the tank wall in plane;

means, carried by the main frame, for externally backing the strip and tank wall across the joint at the tack point with a frame having a curvature corresponding with that of the tank wall when the latter is plumb and in proper curvature; and means, carried by the main frame, for pressing the strip and tank wall against the external backing frame to align them at the tack point.

The movements of components of the machine 1 are actuated by cylinders which, in turn, are activated by electric solenoid valves, preferably proportional valves. The proportional valves control the supply of high pressure hydraulic fluid to the cylinders. These valves are operated by the various inclinometers and receivers, as described above. The design of hydraulic circuits incorporating such valves and needed to operate the cylinders is considered to be routine and within the ordinary skill of the art. Hence they will not be described herein.

The laser sensor broadcaster 43, the laser sensor receivers 46, 84 and the inclinometer assemblies 47, 50, 51, 78 are all conventional, off-the-shelf devices and therefore require no further description.

In addition, the electronic means for operatively connecting the sensor receivers and inclinometers with the relevant solenoid valves, to activate the various cylinders, is conventional and requires no further description.

Undercarriage Assemblies

As previously described, the conveying means comprises front and rear undercarriage assemblies 7, 8.

Figure 4:
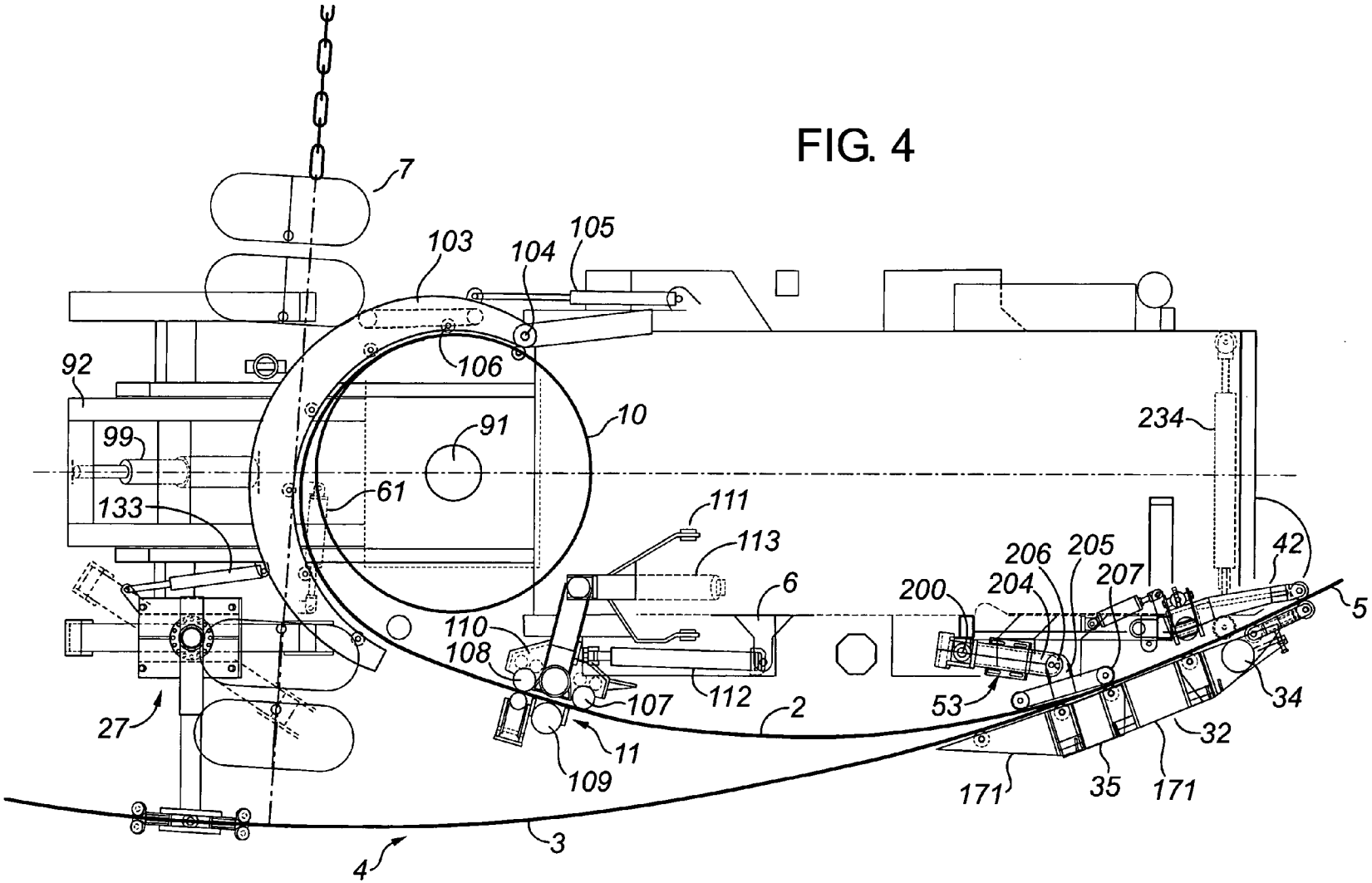
FIG. 4 is a plan view of the machine.
Figure 8:
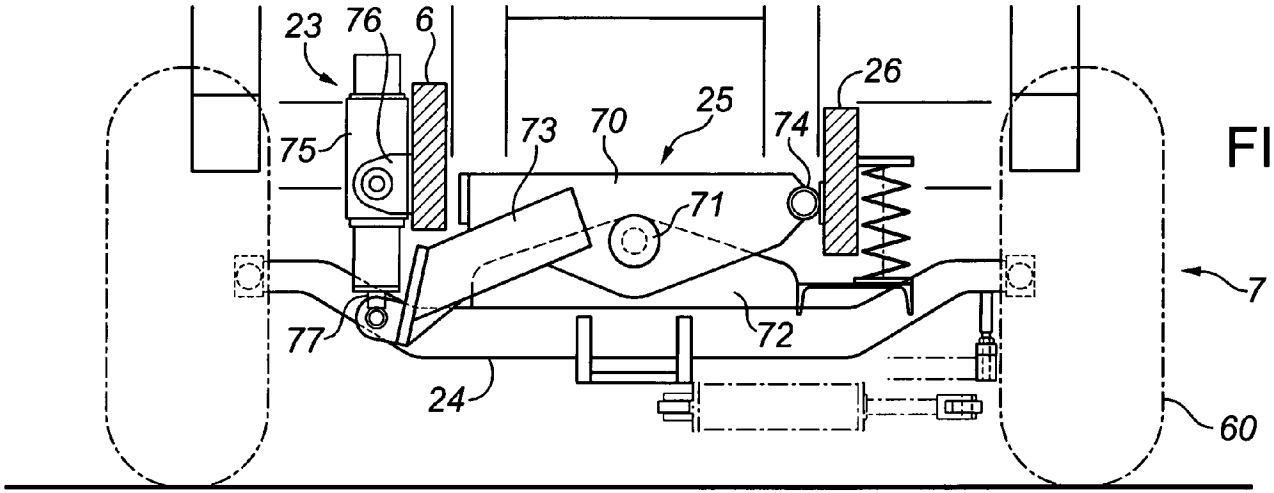
FIGS. 8 and 9 are front views showing the front undercarriage assembly, the pivoting link assembly, the front off-level cylinder and the main frame in lowered and raised positions, respectively.

Having reference to FIGS. 1, 4 and 8 the front undercarriage assembly 7 comprises a front axle 24 mounted to pneumatic wheels 60. A steer cylinder 61 is pivotally connected between the main frame 6 and the axle 24. The steer cylinder 61 can be activated to turn the front steering wheels 60. Conventional electric/hydraulic assemblies (not shown) drive the wheels 60.

As shown in FIGS. 1, 5, 6, 39 the rear undercarriage assembly 8 is a conventional truck rear tandem wheel assembly. It comprises dual axles 62, 63 supporting a pair of pivotally mounted, longitudinally extending, walking balance beams 64. The support cross beam 12 is pivotally and transversely mounted to the balance beams 64 by standard rubber bushings (not shown). Right and left steer cylinders 65, 66 are pivotally connected between the support cross beam 12 and the underside 21 of the main frame 6. The steer cylinders 65, 66 can be selectively activated to turn the rear axles 62, 63 and change the angularity of the cross beam 12.

As a result of being able to steer each of the front and rear undercarriage assemblies 7, 8, the main frame's outer rear corner 33 can be maneuvered to a position just external of the tank wall 3 and conforming to the radius of the tank 4.

Main Frame

The main frame 6 is a rigid plate which carries the components which manipulate and position the tank wall 3 and supply, manipulate and position the strip 2 to achieve proper fit-up at the tack point 5. The elevation, level, front off-level and side shift cylinders 15, 16, 23, 19 suspend this main frame 6 in a floating condition on the undercarriage assemblies 7, 8 and function to adjust its elevation, radius and attitude as required.

Front Off-Level Cylinder and Control

Figure 9:
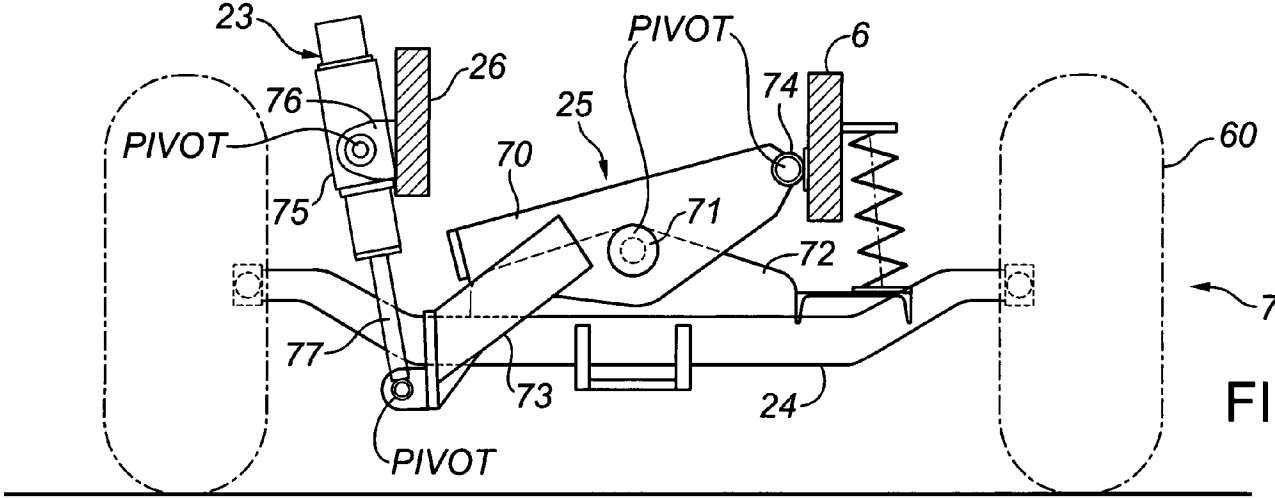
Figure 10:
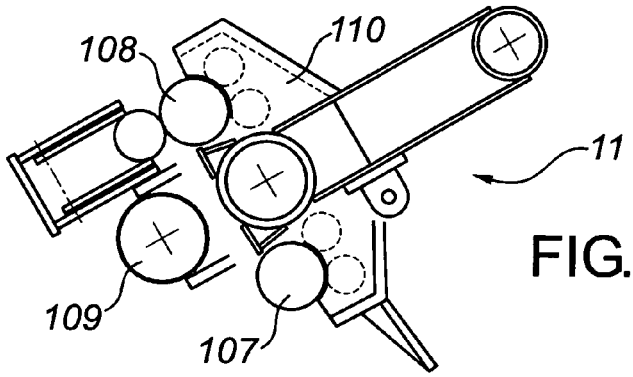
FIG. 10 is a plan view of the straightener assembly.
Figure 11:
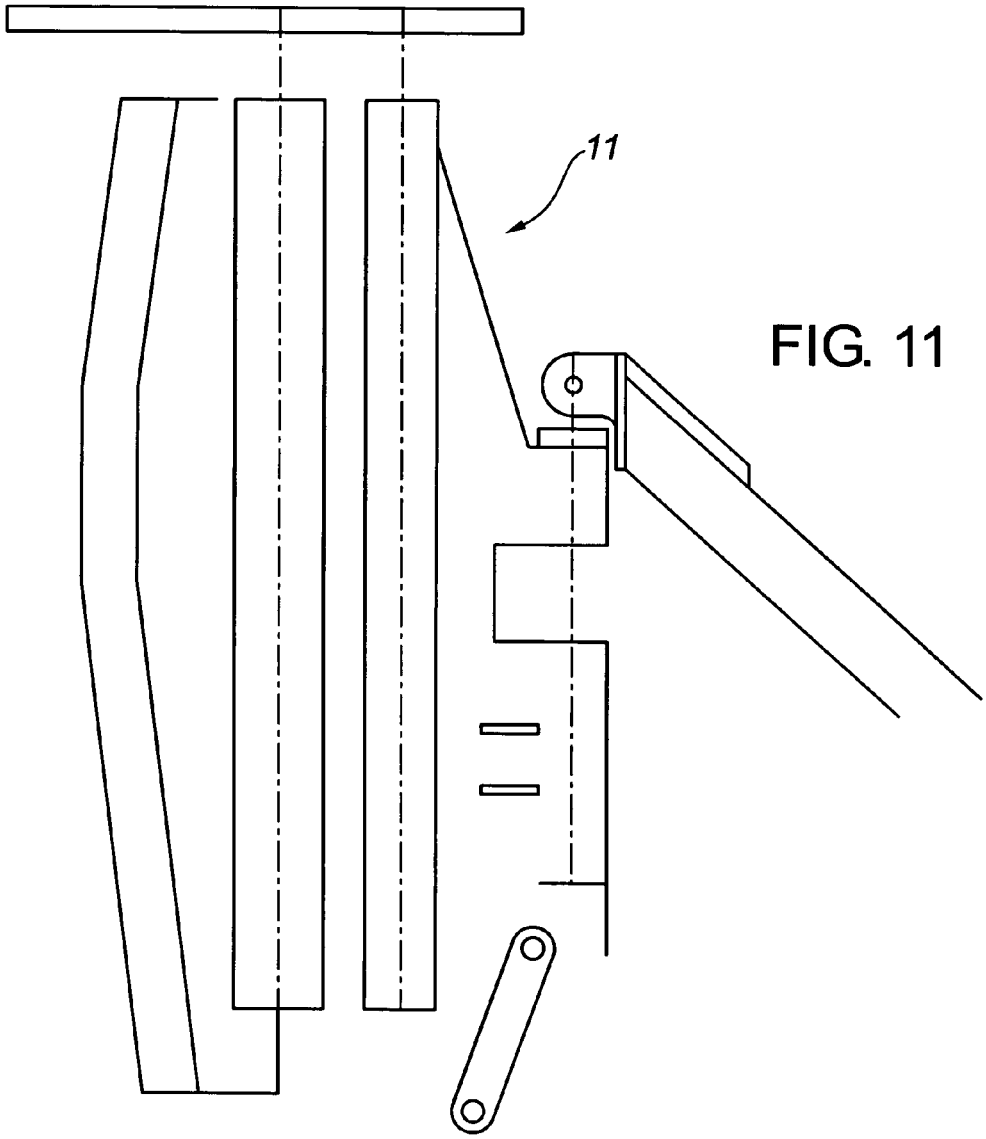
FIG. 11 is a simplified side view of the straightener assembly.
Figure 12:
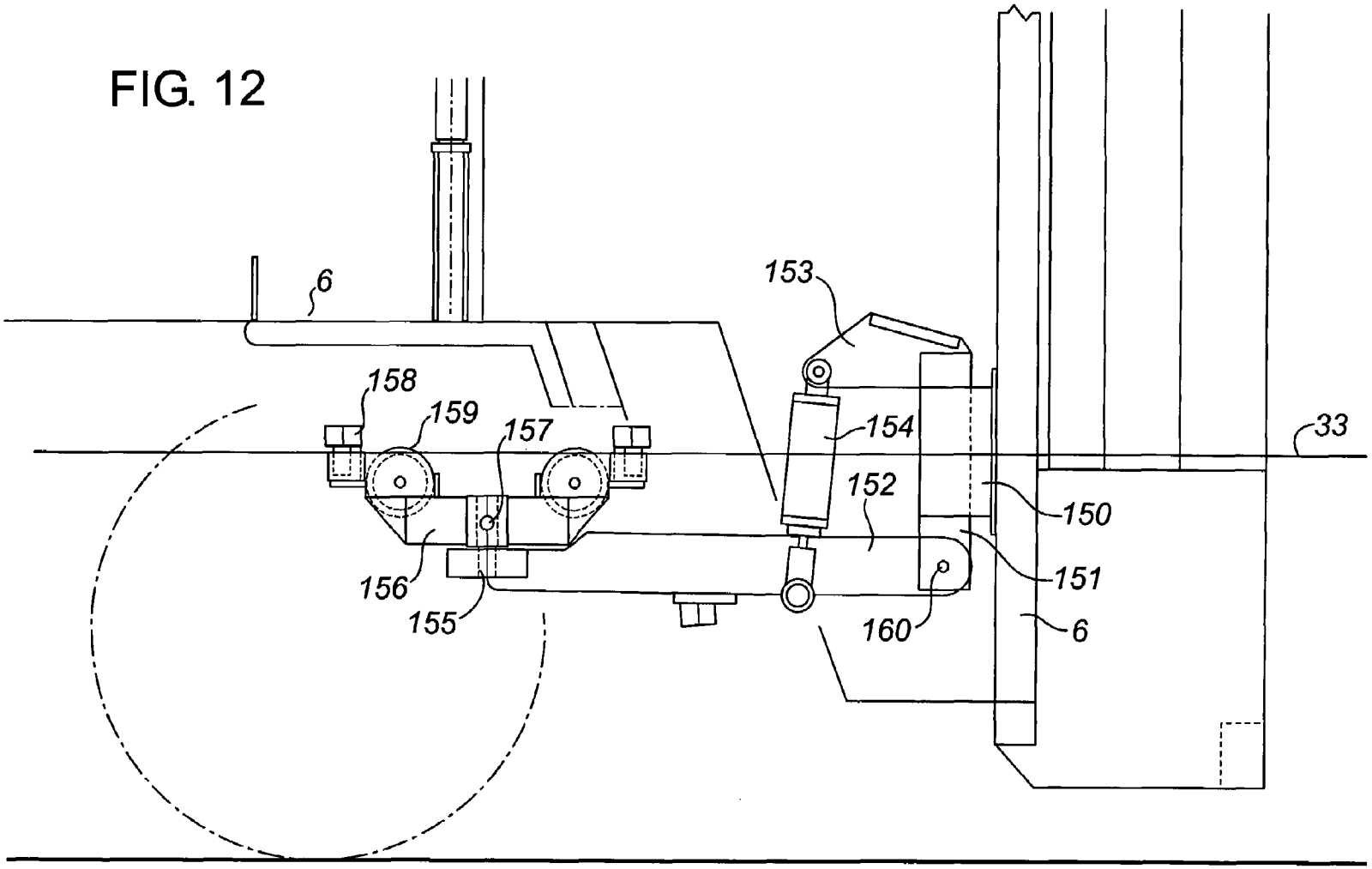
FIG. 12 is a side elevation showing the rear strip carrier roller assembly.

More particularly, having reference to FIGS. 4, 8, 9 at its front end the main frame 6 is supported on the axle 24 of the front undercarriage assembly 7 by the front off-level cylinder 23 and the pivoting link assembly 25. The link assembly 25 comprises a tilting member 70 having a central horizontal pivot pin 71 rotatably mounted to an upright plate 72 attached to the front axle 24. The tilting member 70 is therefore supported on the plate 72 and axle 24 and can tilt side to side. The tilting member 70 further includes an angular arm 73. Viewed from the front, the arm 73 extends downwardly and to the left. The right end of the tilting member 70 is pivotally connected with the right hand side of the main frame 6 by a connection 74. The body 75 of the front off-level cylinder 23 is pivotally connected with the left hand side of the main frame 6 by a connection 76 and its rod 77 is pivotally connected with the angular arm 73. Extension of the front off-level cylinder 23 will evenly and vertically lift both sides of the main frame 6 at its front end, so that it tilts front to back about the universal pivot connections 18 of the elevation and level cylinders 15, 16 with the support cross beam 12. By tilting the main frame 6 front to back (or changing its 'attitude'), the positions of the coil 10 and strip 2 are altered. This has the result of altering the convergence angle of the strip 2 as it approaches the tack point 5. This in turn affects the width of the gap 36 at the tack point 5.

As stated, front off-level cylinder 23 controls the front to back angle of the main frame 6. An inclinometer 78 is horizontally mounted to the main frame 6. The inclinometer 78 (referred to as the front-to-back inclinometer) monitors the angularity of the main frame 6 and operates a control valve supplying hydraulic fluid to the front off-level cylinder 23. At initial set up, the main frame 6 is set at an angle which results in delivery of the strip 2 at a desirable angle producing the desired convergence gap width. The inclinometer 78 is set to operate the control valve and front off-level cylinder 23 so as to maintain the main frame 6 at this desired angle.

During operation, the operator monitors the width of the gap 36 at a point 5 feet ahead of the tack point 5. If the gap 36 opens or closes, the operator can manually adjust the inclinometer 78 to a new setting to assist in correcting the gap width. The inclinometer 78 will thereafter operate to maintain the main frame front to back angle constant at the new value.

It can thus be said that the front off-level cylinder 23 is operative to alter the attitude or front-to-back angle of the main frame 6 as required to maintain an angularity which results in delivery of the strip 2 to the tack point 5 at a desirable convergence angle, so as to produce a gap width which is optimum or very close to it. This operation is responsive to gap width, as read.

Otherwise stated, the front off-level cylinder 23 adjustably maintains the strip convergence angle at a pre-determined setting or value to yield optimum gap width or very close to it. This can be referred to as the 'coarse' control. In addition, relatively fine adjustment to gap width can be realized by 'tweaking' the plumbness of the strip 2 from its lower edge through the action of the level cylinder 16.

Elevation and Level Cylinders and Controls

Figure 7:
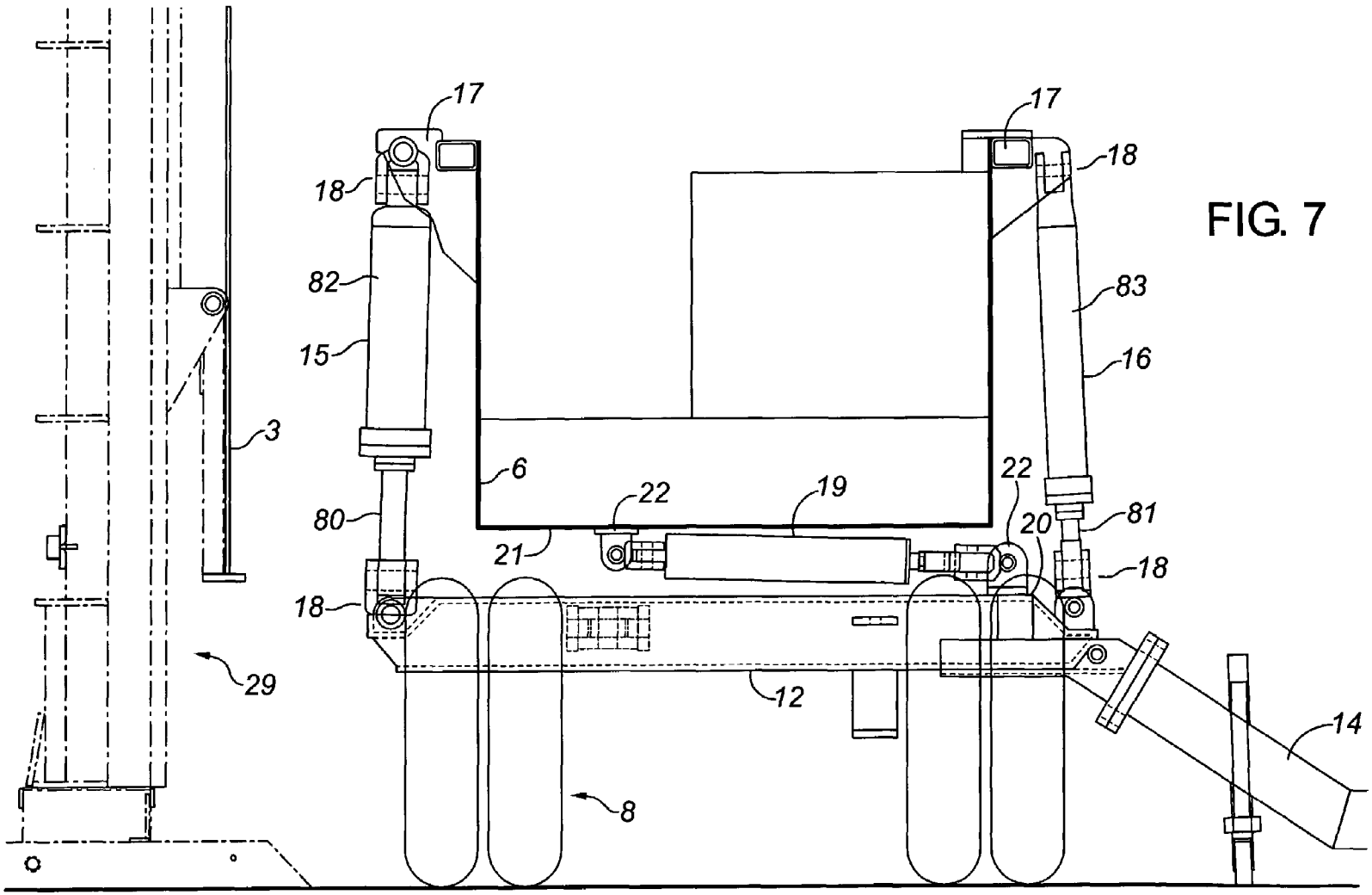
FIG. 7 is a rear end elevation of the machine showing the main frame, the level, side-shift and elevation cylinders, the cross-beam and the radius beam connection, together with an adjacent jack shown in shadow lines, supporting the tank wall.

As previously described, the main frame 6 is also supported intermediate its ends on the support cross beam 12 by the outer 'elevation' and inner 'level' cylinders 15, 16. As shown in FIG. 7, the cylinders 15, 16 are upright. Their rods 80, 81 are connected at their lower ends by 'universal' pivot connections 18 with the outer and inner ends of the support cross beam 12, respectively. Their bodies 82, 83 are connected at their upper ends by universal connections 18 with the side beams 17 of the main frame 6.

The elevation cylinder 15 is controlled by the rear laser sensor receiver 84, shown in FIGS. 1, 28, 30 and 31. The receiver 84 (comprising an array of light cells) is mounted to the main frame 6 by an arm assembly 85, which centers the receiver array at the chalk line 86. The laser beam passes across the receiver array. If the beam is high or low relative to the center of the receiver 84, the latter signals a solenoid valve (not shown) to supply high pressure oil to the elevation cylinder 15, to lower or raise the main frame 6, as required, to bring the chalk line 86 into register with the laser beam.

The level cylinder 16 is controlled by the adjustable X and Y axis level inclinometer assembly 50. This inclinometer assembly 50 is mounted on the main frame 6. It functions to monitor the main frame levelness and signals a solenoid valve (not shown) to supply oil as required to the level cylinder 16, to extend or contract it, to maintain the main frame 6 at a pre-set side-to-side level.

The level cylinder 16 reacts to changes in elevation of the main frame 6 caused by the elevation cylinder 15. As the latter expands or contracts, the main frame 6 will go out of side-to-side level. The level inclinometer assembly 50 reads this and causes the level cylinder 16 to adjust to maintain the main frame 6 side to side level, as pre-set.

Similarly, the front-to-back inclinometer 78 is monitoring the front-to-back angularity of the main frame 6, which will change when the elevation and level cylinders 15, 16 begin adjusting the elevation and side-to-side level of the main frame 6. The front-to-back inclinometer 78 therefore causes the front off-level cylinder 23 to adjust to maintain the pre-set front-to-back angularity as the elevation of the main frame 6 changes.

Thus, collectively the cylinders 16, 23 and their monitoring/control means react to adjustment of the elevation cylinder 15 to maintain the desired pre-set side-to-side and front-to-back attitudes or angularities of the main frame 6 when it undergoes elevation change.

Side Shift Cylinder and Control

Figure 5:
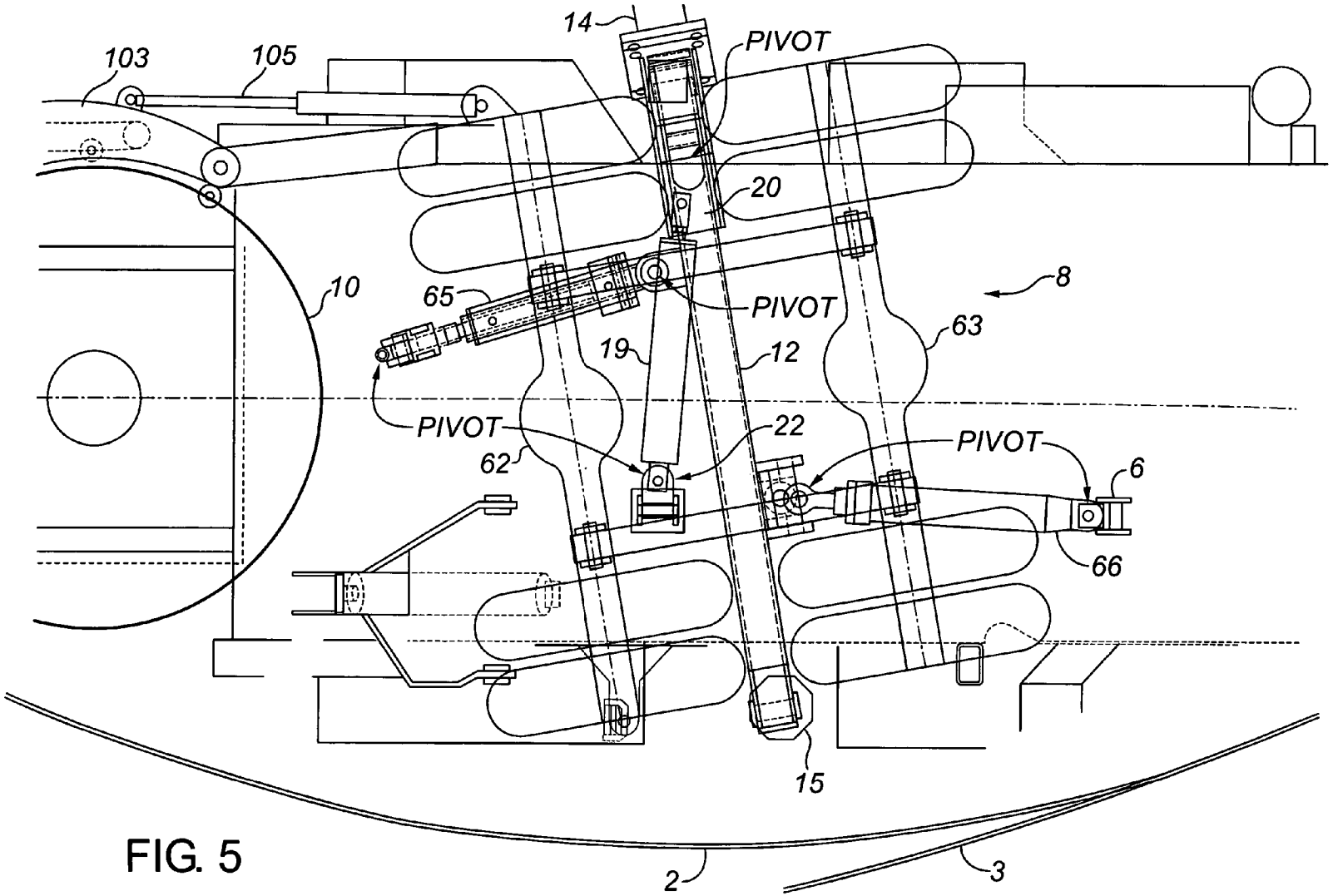
FIG. 5 is a plan view showing the rear undercarriage assembly, the rear steer cylinders and the cross-beam.

Having reference to FIGS. 5 and 7, the side shift cylinder 19 is connected to the inner end of the cross beam 12 and the outer underside 21 of the main frame 6 by the pivot connections 22.

Thus the side shift cylinder 19 can vary the radius of the main frame 6, with the elevation and level cylinders 15, 16 tilting therewith. The main frame 6 moves along a slight arc when radius is adjusted. Even though the main frame 6 is rigidly connected at its front end to the front axle 24 by the pivot pin 71, this radius change movement is accommodated by swinging the main frame on the front tires 61.

The side shift cylinder 19 is actuated by the vertical rear inclinometer assembly 49, which is monitoring the plumbness of the tank wall 3 at the tack point 5.

When the side shift cylinder 19 adjusts the radius of the main frame 6 in response to the rear inclinometer assembly 49, the elevation and attitude of the main frame 6 will change. This is read by the monitoring/control means of the cylinders 15, 16 and 23 and the latter collectively adjust to maintain the desired main frame elevation and attitude.

Turntable Assembly

Having reference to FIGS. 4 and 19–26, a turntable assembly 9 is provided for picking up a coil 10 and rotating it to the operative position. More particularly, the turntable assembly 9 comprises a driven rotatable turntable 90 having an attached vertical post 91. The turntable 90 is supported on a tilt frame 92 mounted to the main frame 6 by a horizontal pivot shaft 93. The turntable 90 is driven by a turntable drive assembly (not shown) comprising a hydraulic motor, sprocket and chain. The turntable 90 and its drive assembly 94 form a unit which is connected with a vertical plate 97, which threadably engages a pair of screw shafts 98 mounted to the tilt frame 92. As shown in FIGS. 19–22, the turntable 90 can be advanced along the tilt frame 92 by turning the screw shafts 98, until it reaches the far end of the frame. A cylinder 99, pivotally connected between the front undercarriage 7 and the tilt frame 92, can then be activated to tilt the frame to bring the post 91 to a horizontal position. The post 91 can then be driven into the central opening of a horizontal coil 10. A winch line 100, passing over a pulley 101 carried by the upper end of the tilted frame 92, can then be reeled in by a winch 102 carried by the main frame 6. The coil 10 is thereby rotated to an upright position. The screw shafts 96 are then rotated to move the turntable 90 and its drive assembly back to the operating position.

An arcuate C-arm 103 is pivotally mounted to the main frame 6 by a connection 104. The C-arm 103 functions to control strip 2 being fed from the coil 10 and guide it to the straightening assembly 11. The position of the C-arm can be adjusted by a cylinder 105 pivotally connected between the main frame 6 and the C-arm 103. A series of vertical rollers 106 are mounted along the inner surface of the C-arm 103, to facilitate the movement of the strip 2.

Straightening Assembly

The straightening assembly 11 functions to straighten the strip 2 to make it easily conformable to the curvature of the tank wall 3. The straightening assembly 11 can be adjusted radially and vertically. The positions of the crush rolls can be adjusted to vary the curvature of the straightened strip, as required.

More particularly, having reference to FIG. 4, the straightening assembly 11 comprises a pair of inner rolls 107, 108 and an outer crush roll 109, all mounted for rotation in roll frame 110. The inner rolls 107, 108 are driven by a hydraulic motor (not shown). The rolls 107, 108 and 109 constitute a vertically oriented, conventional pyramid roll assembly such as is commonly used to roll steel shell. The roll frame 110 is pivotally mounted to the main frame 6 by pivot connections 111. The outer crush roll 109 can be moved in or out in the frame 110, to adjust its proximity to the inner rolls 107, 108, thereby altering the extent of deflection applied to the strip 2. A hydraulic swing cylinder 112 is attached at it's lower end to frame 110 and is pivotally connected to main frame 6, to enable adjustment of the verticality of the rolls or right angledness of the strip relative to the rolls. The position of the strip 2 is monitored or tracked by a proximity switch (not shown) which controls an electric valve (not shown) which controls cylinder 112. The strip 2 has a tendency to walk up or down along the pyramid rolls, which results in jamming. Adjustment of the verticality of the pyramid rolls can alleviate this problem. In addition, the swing cylinder 112 can be used to aim the straightened strip 2 toward the point at the tank wall 3 where inside back-up tandem roller assembly 53 directs the strip 2 into alignment with the tank wall.

Forward Carrier Roller Assembly

Having reference to FIGS. 13–18, the forward carrier roller assembly 27 comprises a set of grooved rollers 120 which engage and support the bottom rim or edge 28 of the tank wall 3. The grooved rollers 120 are carried in a frame 121 which is pivotally mounted on the end of a horizontal arm 122. The arm 122 is received at its inner end in a horizontal sleeve 123. The arm 122 can be shifted radially along the sleeve 123 to adjust the radius of the grooved rollers 120 at set-up. A pin 124 is used to lock the arm 122 in the sleeve 123 at a desired position. The sleeve 123 is mounted on the top end of a vertical post 125. The post 125 is attached to a carriage 126. The carriage 126 is secured to and can slide along an upwardly angled track 127 supported by a hollow square tube 128. The carriage 126 is secured to the track 127 by rollers 129.

A cylinder 130 is positioned within the square tube 128 and is connected thereto at one end. At its other end the cylinder 130 is connected to the carriage 126. The cylinder 130 is operative to move the carriage 126 up or down along the track 127, to vary the elevation of the grooved rollers 120 and the bottom edge 28 of the tank wall 3. The forward carrier laser sensor receiver 46 controls a valve (not shown) which actuates the cylinder 130 to vary the elevation of the tank wall bottom edge 28.

The angularly extending square tube 128 is mounted to the upper end of a pivot pin 131 rotatably received in a sleeve 132. The sleeve 132 is attached to the main frame 3 and extends upwardly. The square tube 128 can thus swing about the axis of the pivot pin 131, thereby varying the radius of the grooved rollers 120 and thus maintaining the radius of the tank wall 3. Having reference to FIG. 4, a swing cylinder 133 is connected between the main frame 3 and the square tube 128.

The forward vertical inclinometer assembly 47 operates the valve (not shown) actuating the swing cylinder 133, to radially swing the forward carrier roller assembly 27 and thereby adjust the radius and plumbness of the tank wall 3.

Figure 13:
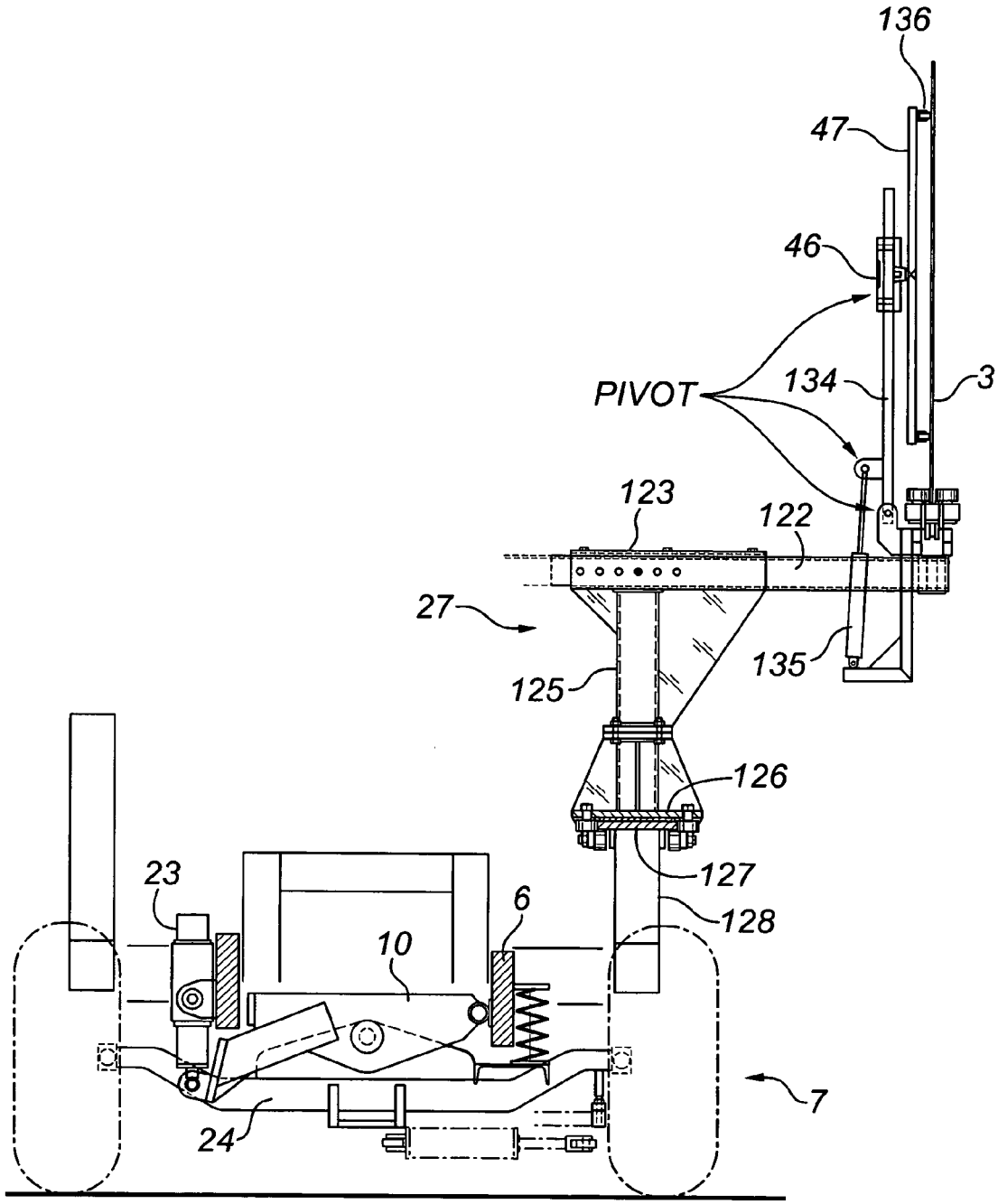
FIG. 13 is a front elevation showing the forward carrier roller assembly and the forward vertical inclinometer and laser receiver.
Figure 14:
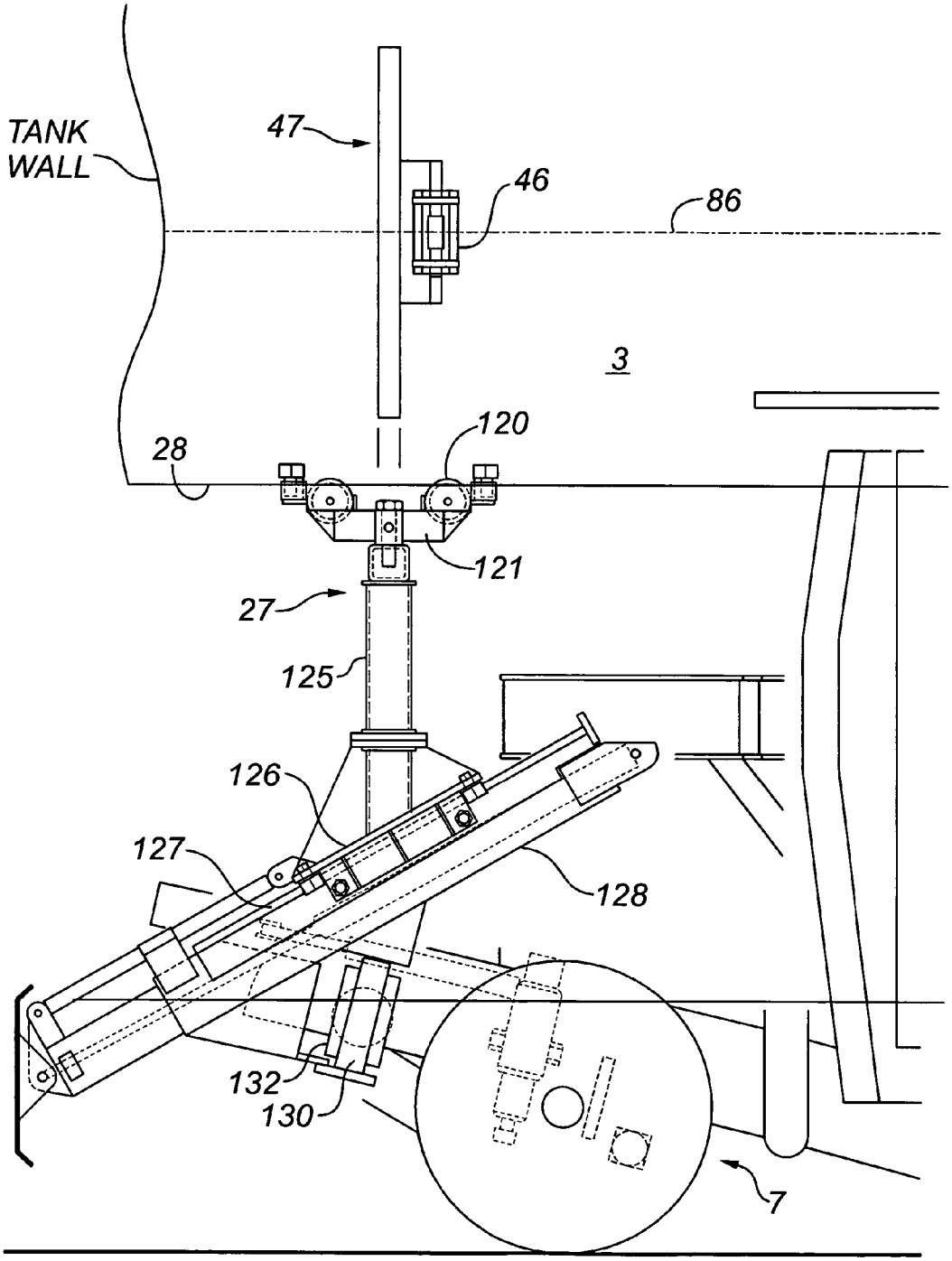
FIG. 14 is a side view of the assembly shown in FIG. 13.
Figure 16:
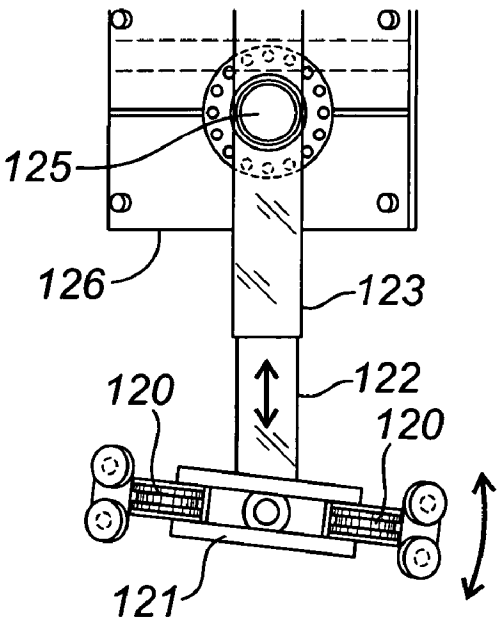
FIG. 16 is a plan view of part of the forward carrier roller assembly.
Figure 15:
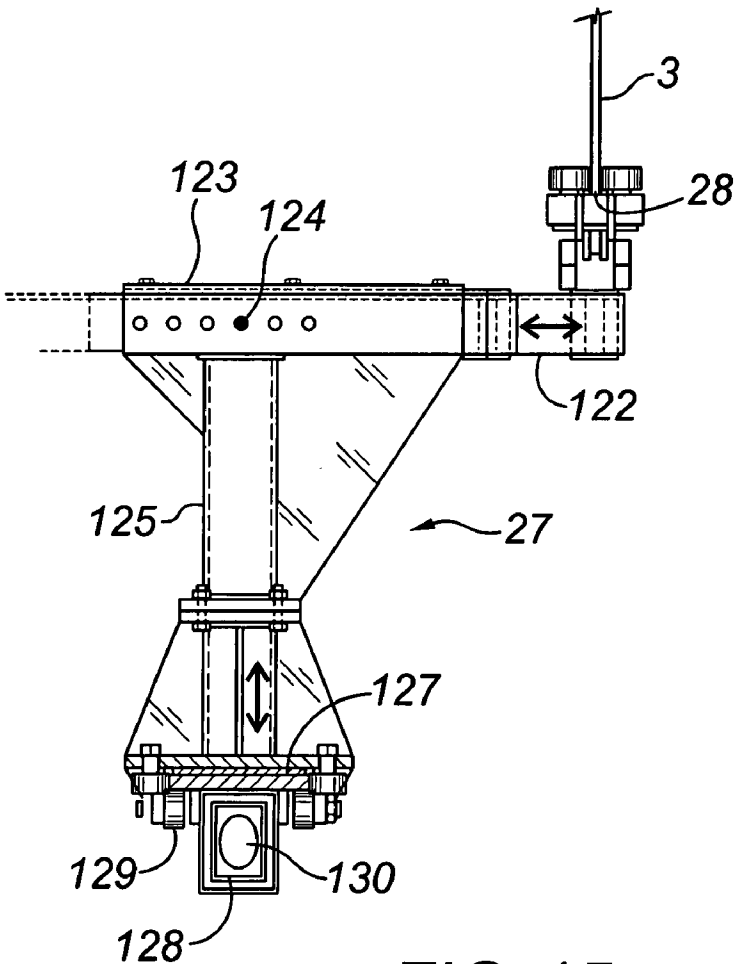
FIG. 15 is a front view of the forward carrier roller assembly.
Figure 18:
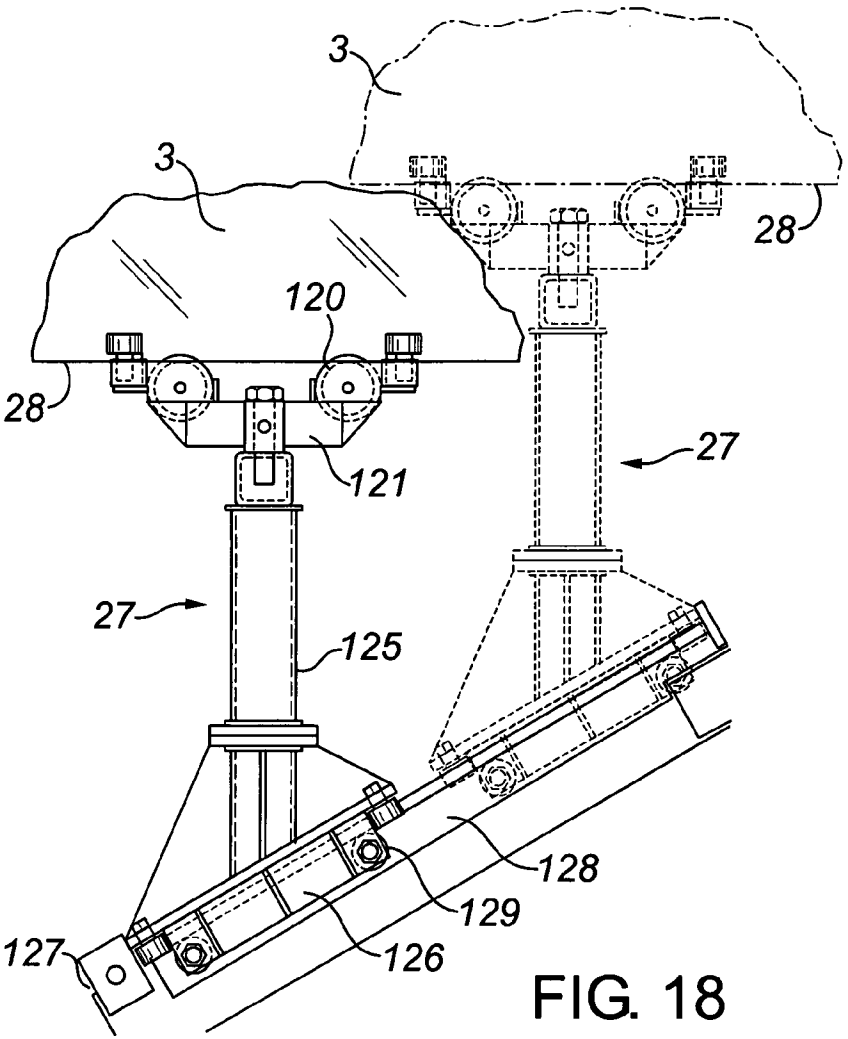
FIG. 18 is a side view showing the forward carrier roller assembly in lowered and raised positions.
Figure 17:
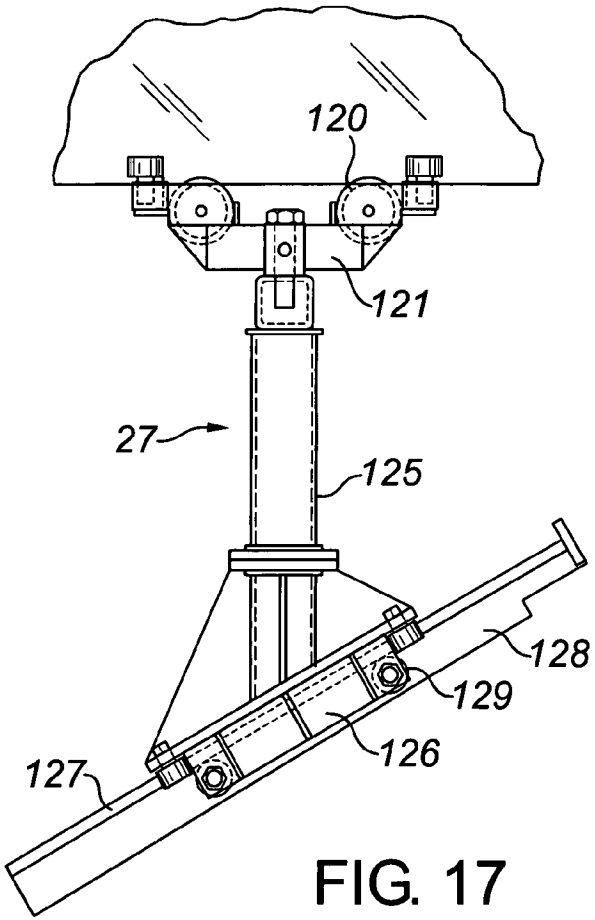
FIG. 17 is a side view of the forward carrier roller assembly.
Figure 19:
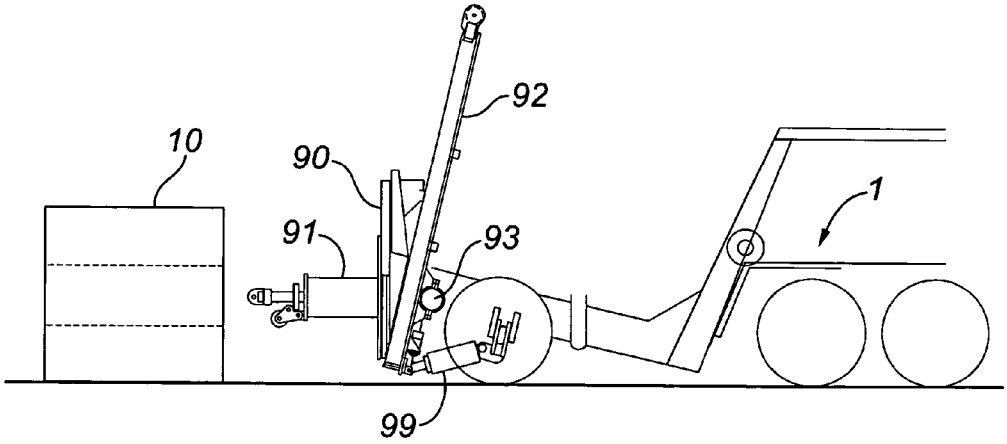
FIGS. 19–22 are schematic side views showing a coil of strip being loaded onto the turntable assembly.
Figure 20:
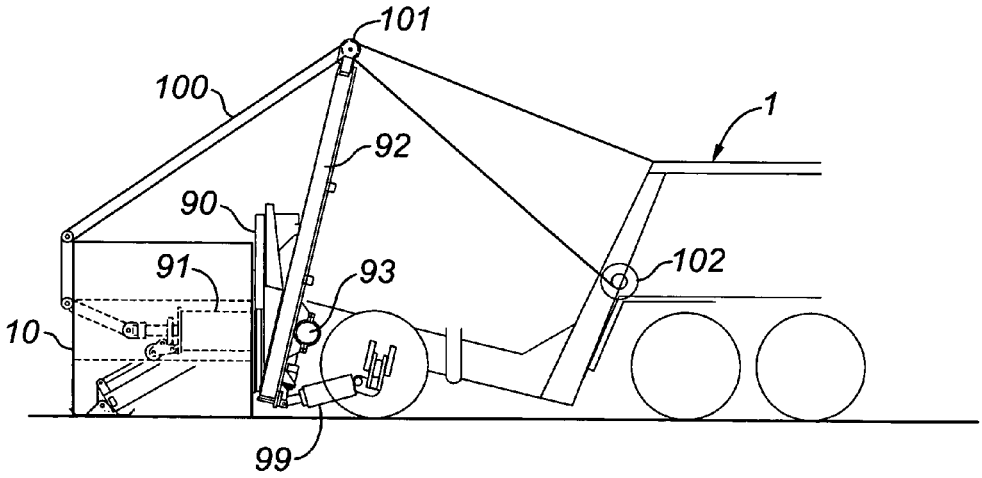
Figure 21:
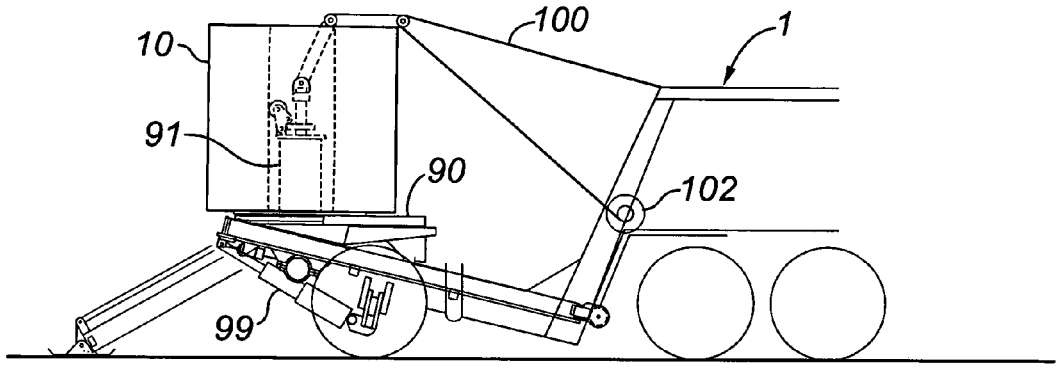
Figure 22:
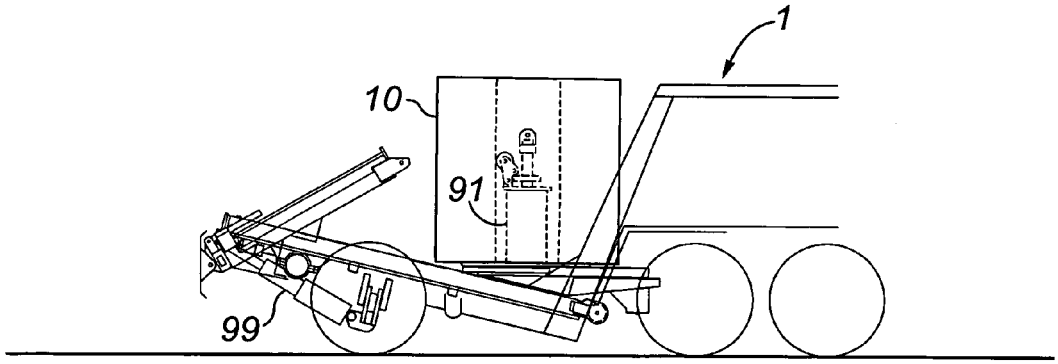
Figure 23:
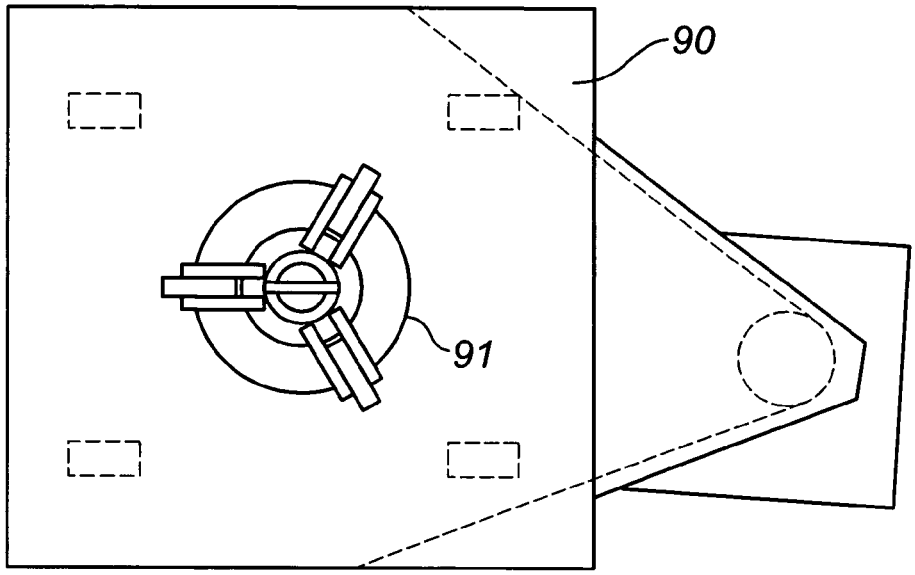
FIG. 23 is a plan view of the turntable assembly.
Figure 24:
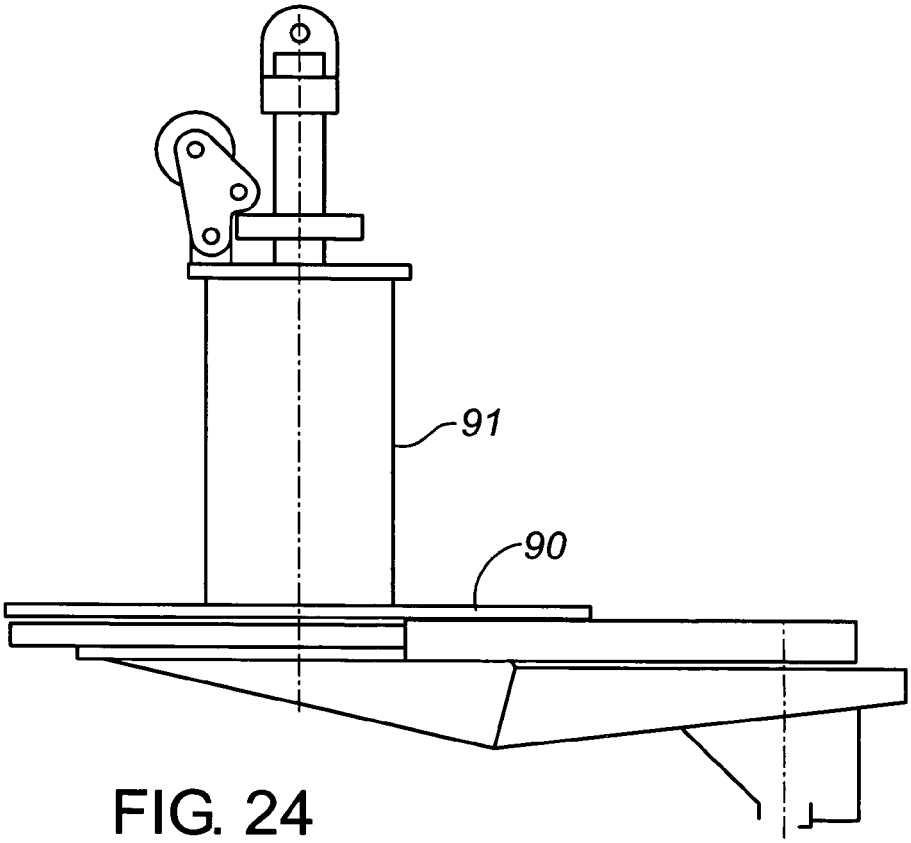
FIG. 24 is a side view of the turntable assembly shown in FIG. 23.
Figure 25:
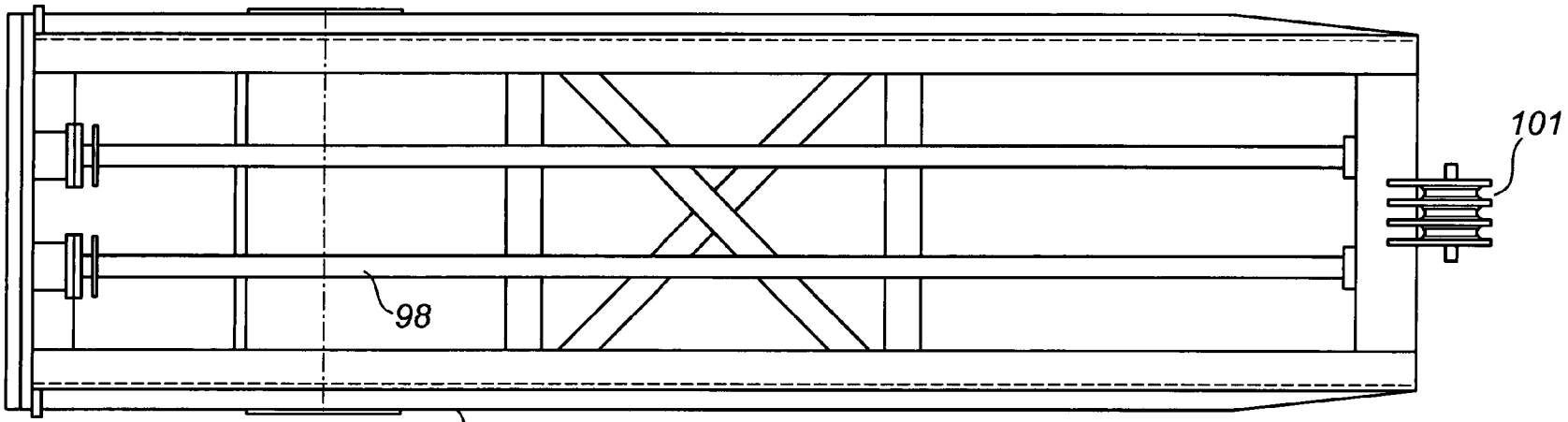
FIG. 25 is a plan view of the turntable tilt frame.
Figure 26:
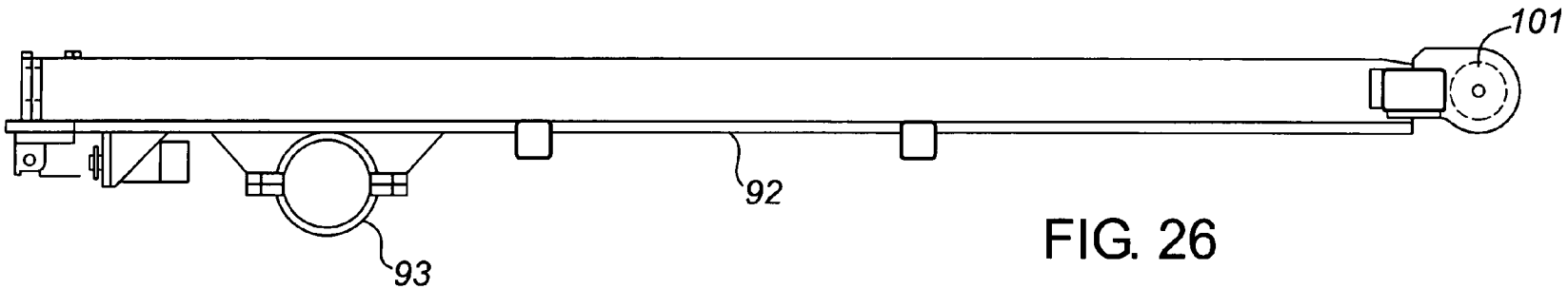
FIG. 26 is a side view of the turntable tilt frame.

Having reference to FIG. 13, the arm 122 of forward carrier roller assembly 27 also pivotally supports a rod 134 carrying the forward laser sensor receiver 48 and the forward vertical inclinometer assembly 47. A small air cylinder 135 is connected between the rod 134 and the arm 122 and functions to press the rollers 136 of the inclinometer assembly 47 against the tank wall 3.

Rear Carrier Roller Assembly

Having reference now to FIGS. 1, 6, 12 and 35, they show the strip rear carrier roller assembly 30. The assembly 30 is connected to the main frame 6 by a vertical pivot sleeve 150. A pivot pin 151 extends through the pivot sleeve 150. A carrier arm 152 is pivotally connected at its rear end to the bottom end of the pivot pin 151 by pivot pin 160. A pivot arm 153 is connected at its rear end to the upper end of the pivot pin 151. An upright cylinder 154 is pivotally connected between and to the carrier arm 152 and pivot arm 153, for pivoting the carrier arm up or down about its pivot connection with the pivot pin 151. A generally horizontal cylinder 161 is pivotally connected to and between the main frame 6 and the carrier arm 152. The cylinder 161 can swing the carrier arm 152 in a horizontal plane. A vertical pivot pin 155 is rotatably mounted to the forward end of the carrier arm 152. A roller support frame 156 is pivotally mounted to the vertical pivot pin 155 by a horizontal pivot pin 157. The support frame 156 carries a pair of balanced, grooved, longitudinally spaced apart guide rollers 158. The strip's bottom rim 31 is supported by and held by the grooved rollers 159.

The forward end of the carrier arm 152 can thus be swung in and out in a horizontal plane by the cylinder 161. And it can be rotated up or down, about the pivot pin 160, by the cylinder 154. The roller support frame 156 and its grooved rollers 159 can rotate in a horizontal plane about the vertical pivot pin 155 and can tilt in a vertical plane about the horizontal pivot pin 157.

Thus, at set up, the cylinders 161, 154 are actuated, to swing and raise the grooved rollers 159 to engage the bottom rim 31 of the strip 2. The cylinders 161, 154 are then locked, with the strip at 90° to the plane of the main frame 6. The rear carrier roller assembly 30 now moves with the main frame 6. Tilting of the main frame 6 to one side or the other will change the verticality or plumbness of the strip 2.

Fitting Frame Assembly

Having reference to FIGS. 1, 4, 6, 32 and 33, the external fitting frame assembly 32 provides several functions, namely:

- it cooperates with the inside push-out assembly 40 (see FIG. 27) to guide the strip 2 into alignment beneath the tank wall 3 and ahead of the tack point 5. If the fitting frame assembly 32 were not there, the strip 2 would flow outwardly. By aligning the two plates, the width of the gap 36 can be accurately measured, which is desirable as a pre-condition to making adjustments;
- the fitting frame assembly 32 also serves to impose desirable curvature and plumbness to the strip 2 and tank wall 3 in the vicinity of the tack point 5; and
- in accomplishing the foregoing it desirably affects the gap spacing.

Having reference to FIGS. 1, 4, 32 and 33, the fitting frame assembly 32 comprises:

- a vertical post 34 affixed at its base to the outside rear corner 33 of the main frame 6;
- an articulating arm 171 rotatably mounted to the post 34 at the latter's upper end. The arm 171 is formed in sections 172 which are pivotally connected together at their ends so that the arm can be curved along its length and set to the desired curvature. The arm 171 can be locked to the post 34 and the sections 172 can be locked together to form a fixed arcuate horizontal frame;
- the arm 171 straddles the horizontal joint 37 and has internal, rotatably mounted rollers 173 which bear against the outer surfaces 174, 175 of the strip 2 and tank wall 3.

Figure 29:
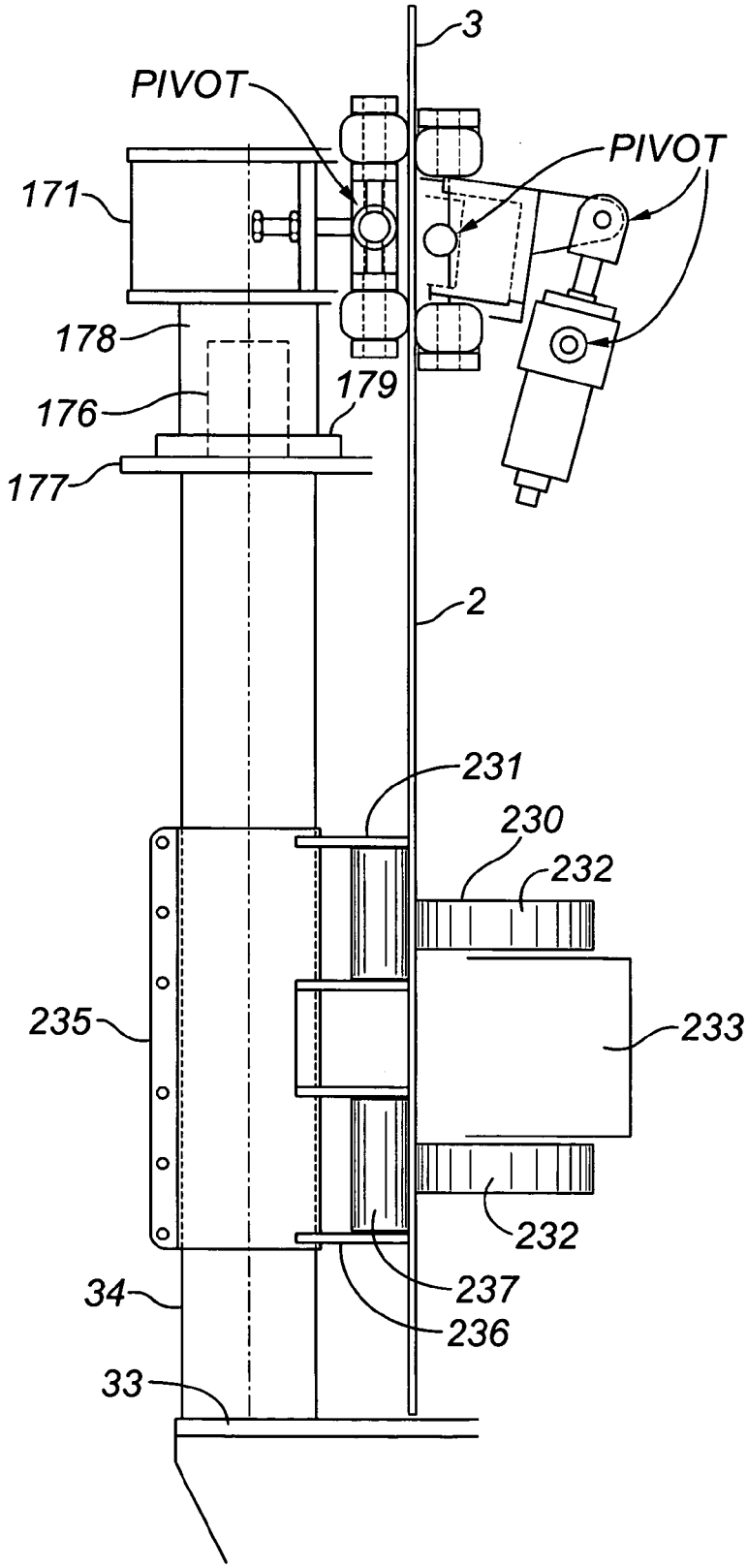
FIG. 29 is a rear view of the hi-lo assembly.
Figure 30:
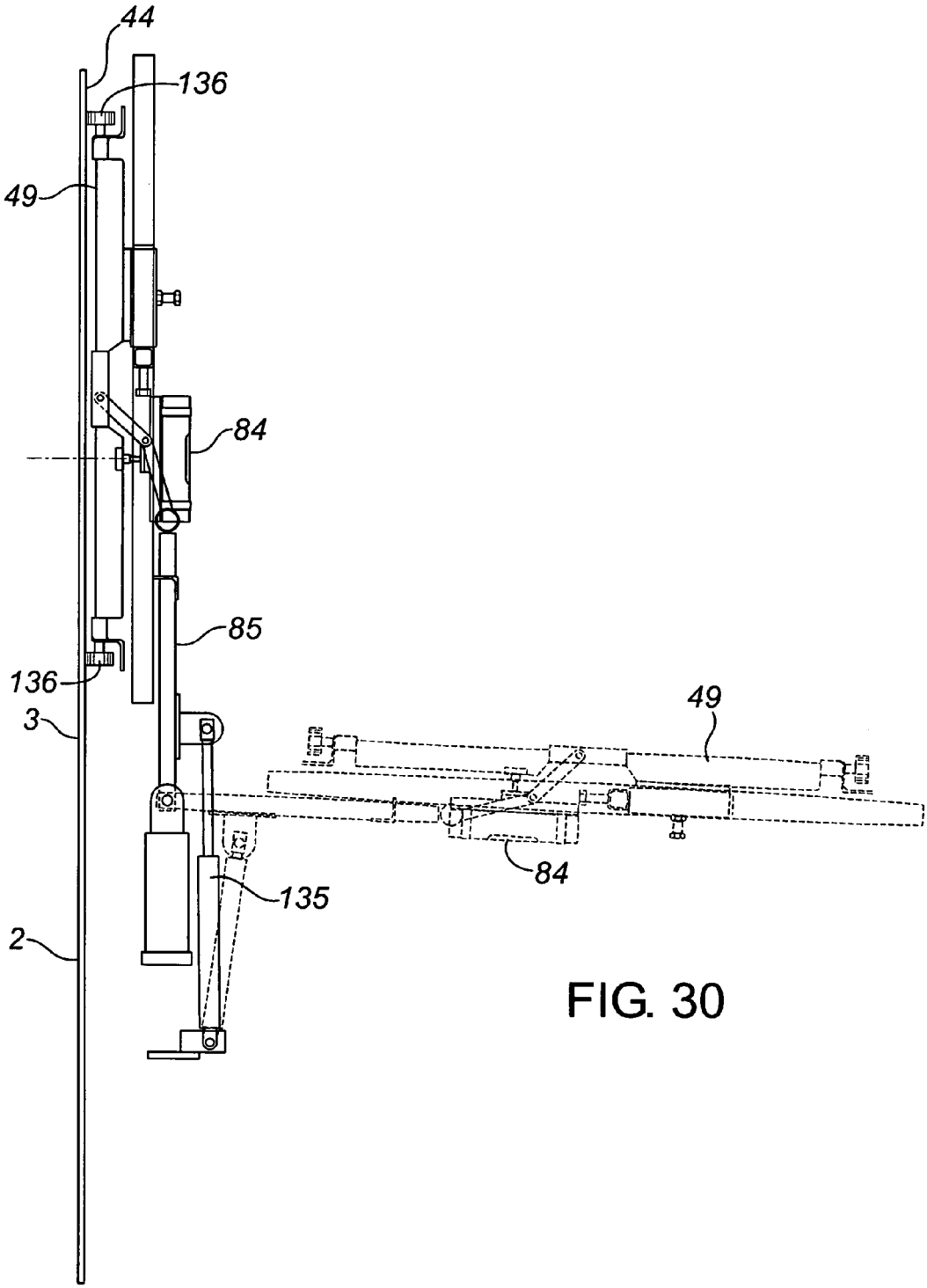
FIG. 30 is a rear view of the rear vertical inclinometer assembly.
Figure 31:
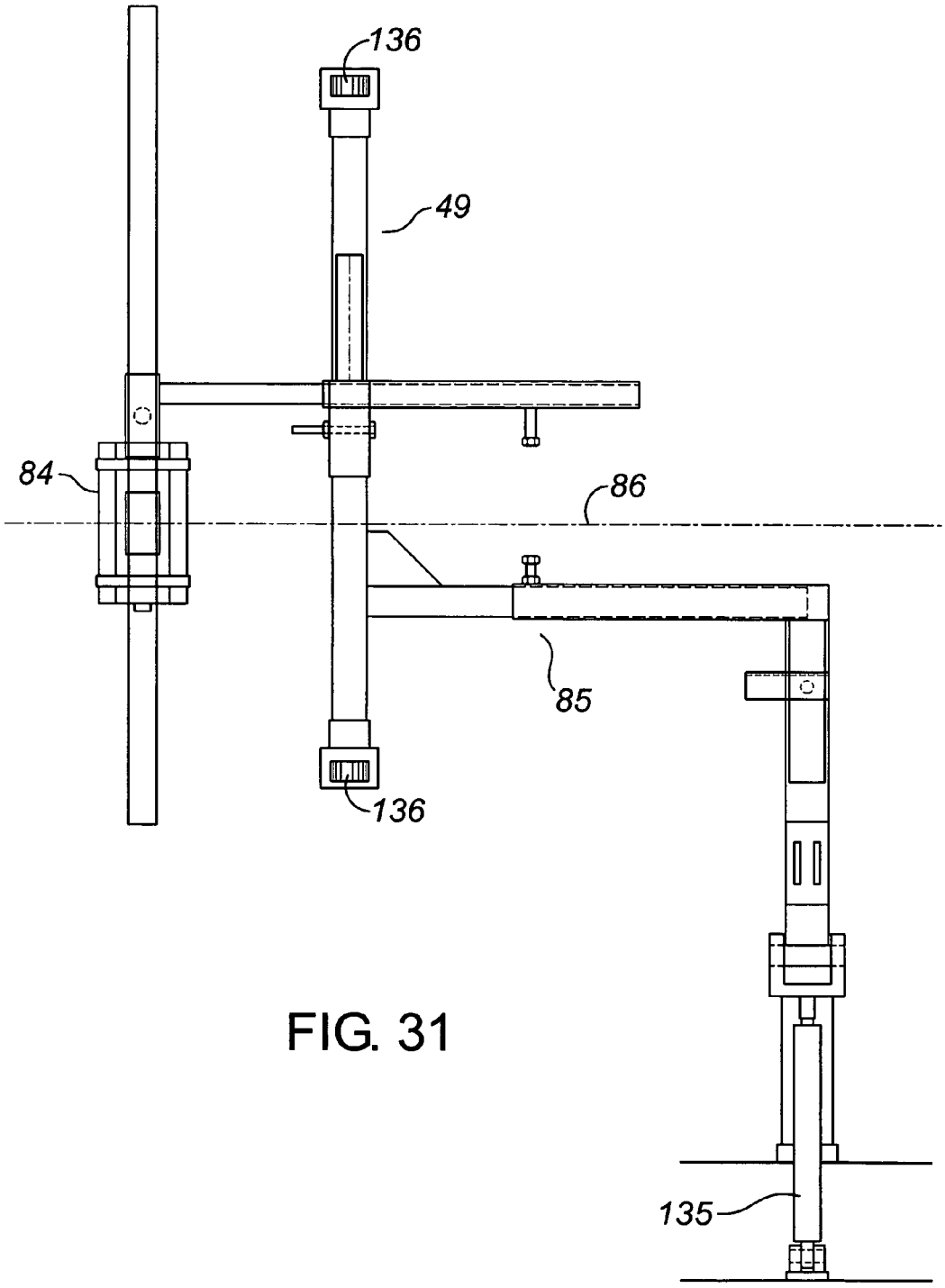
FIG. 31 is a side view of the inclinometer assembly of FIG. 30.
Figure 32:
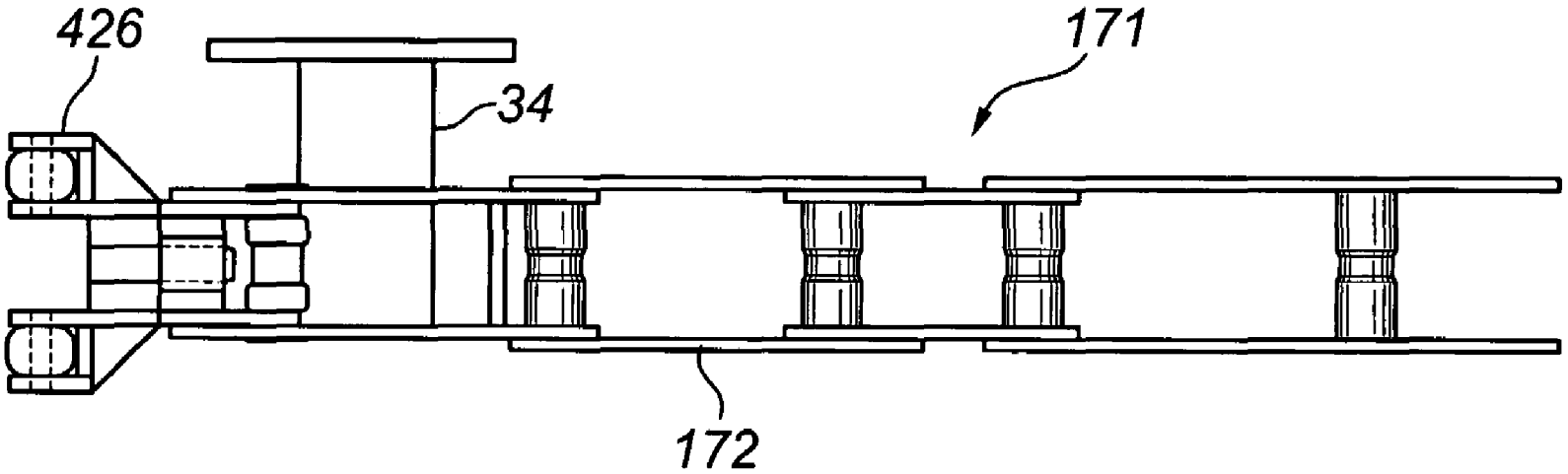
FIG. 32 is a side view of the fitting frame.

Having reference to FIG. 29, the post 34 has a reduced diameter head 176 at its upper end. A slotted plate 177 protrudes radially from the post 170 at the base of the head 176. The fitting arm 171 has a downwardly extending sleeve 178 and slotted base plate 179, which drop over the post head 176. The fitting arm 171 can be rotated to adjust its position and then locked in place using screws (not shown) extending through the slots (also not shown) of the plates 179, 177.

Figure 33:
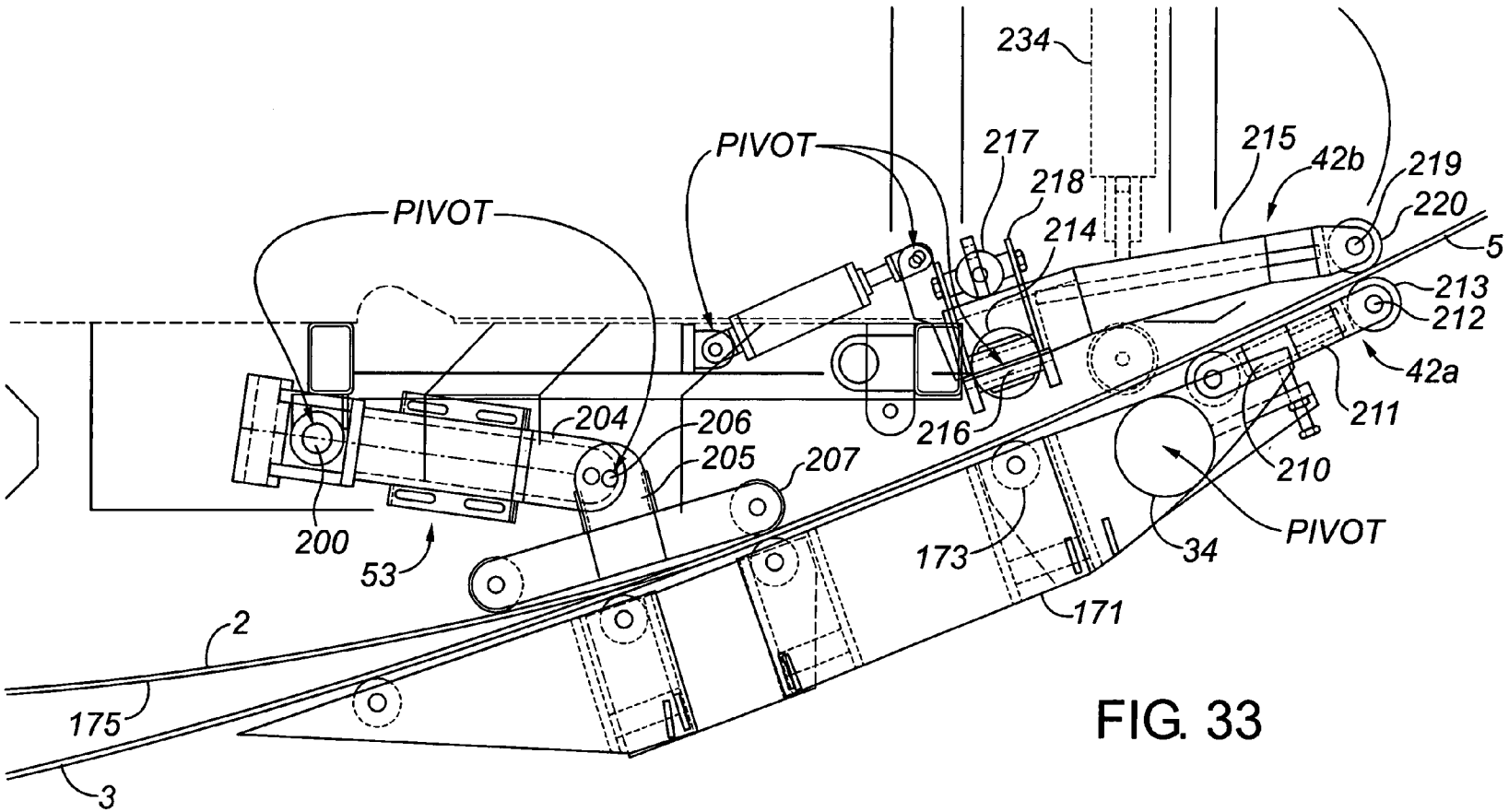
FIG. 33 is a plan view of the fitting frame, inside back-up tandem roller assembly and hi-lo assembly.
Figure 34:
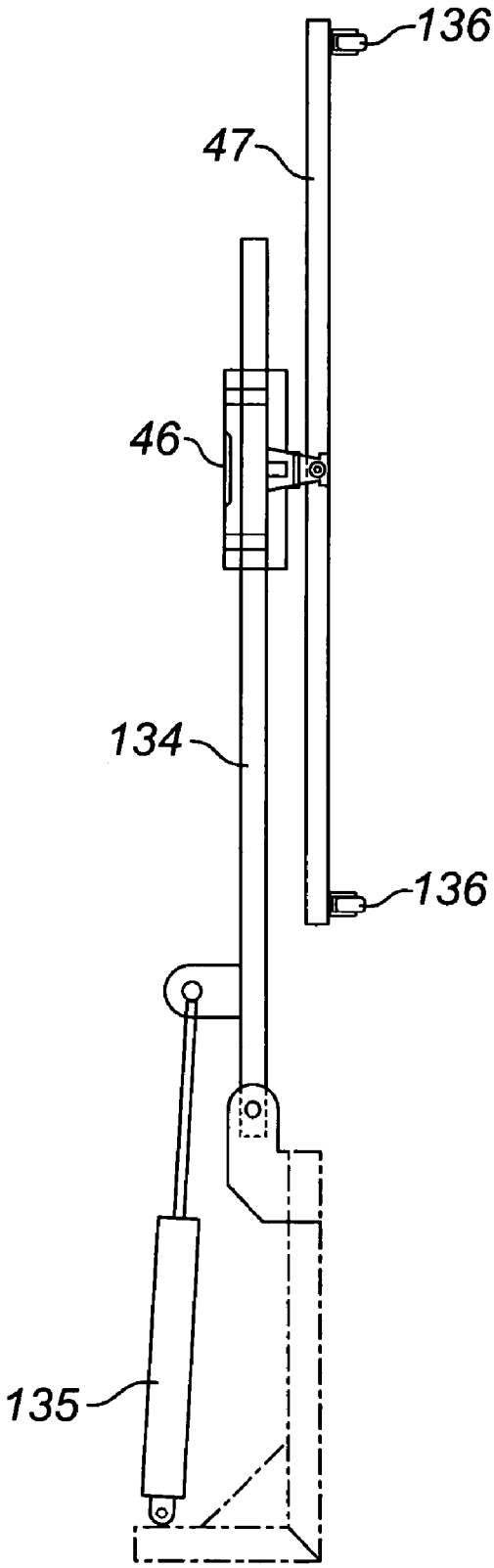
FIG. 34 is an end view of the forward carrier laser sensor assembly.

The fitting arm 171 is formed in sections 172 having overlapping ends 180 pivotally connected by pins 181. The sections 172 carry the rotatable rollers 173. Screws 182 can be inserted as shown in FIG. 33 to lock the sections 172 together in a fixed arcuate configuration.

Inside Push-Out Assembly

Figure 2:
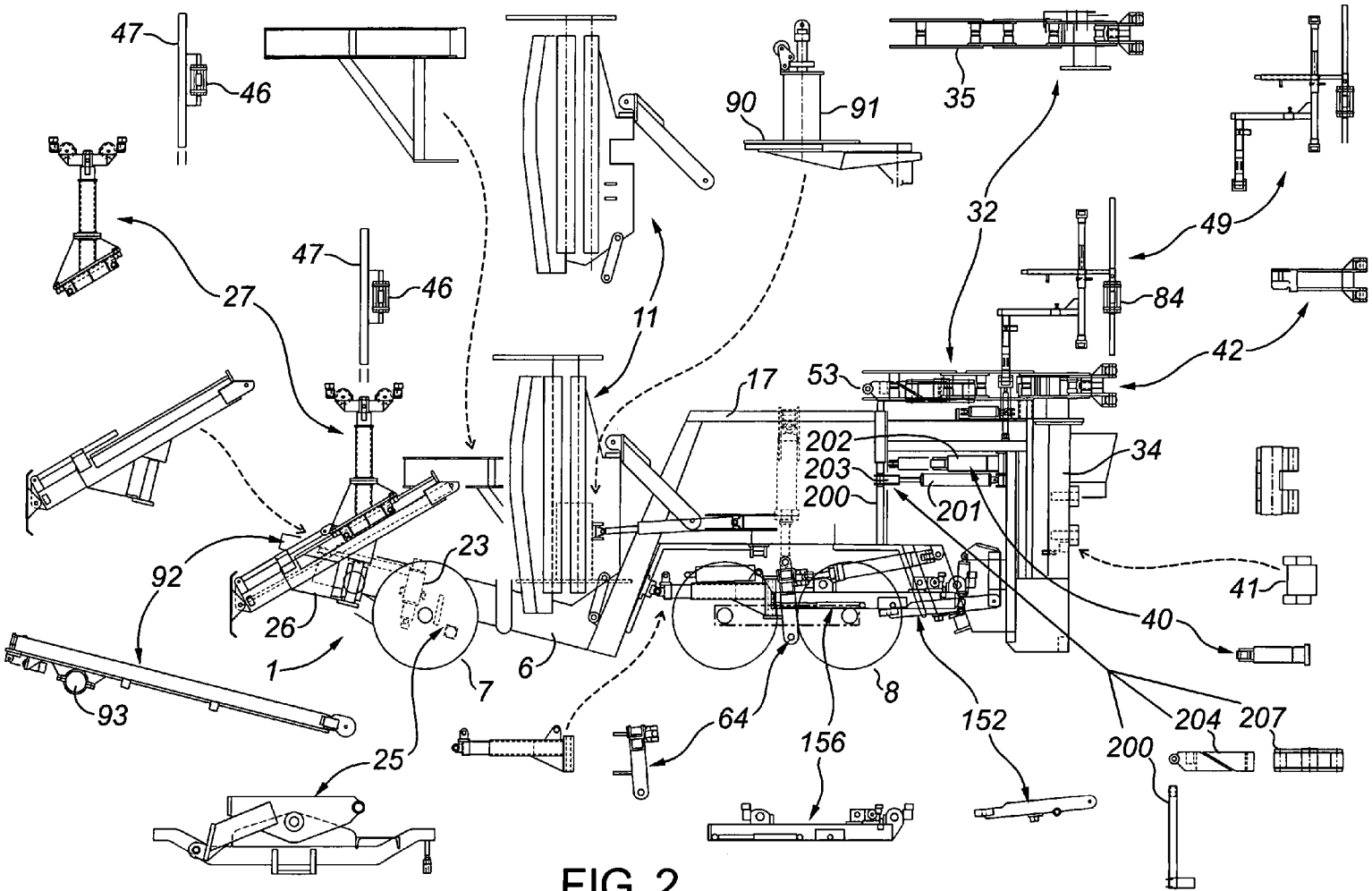
FIG. 2 is a side elevation of the machine with various components and their locations also shown.
Figure 3:
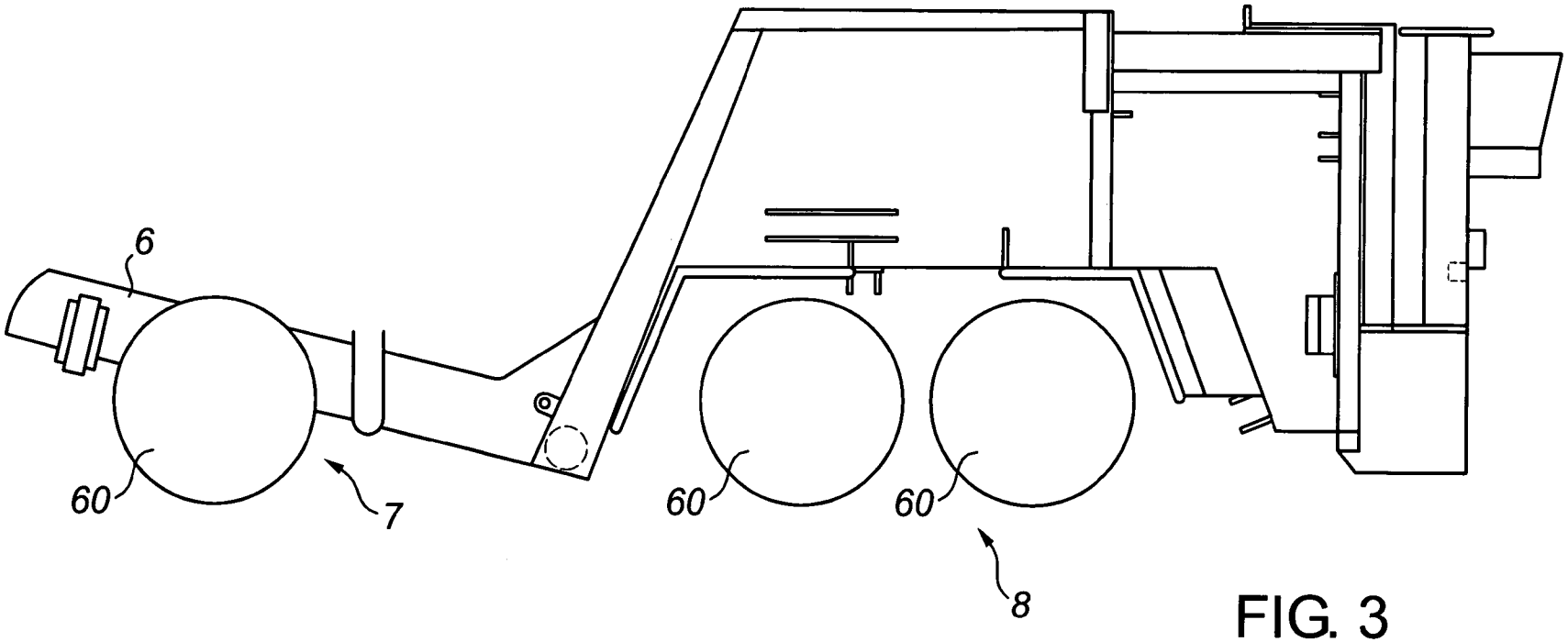
FIG. 3 is a simplified side view of the machine, showing the main frame.
Figure 6:
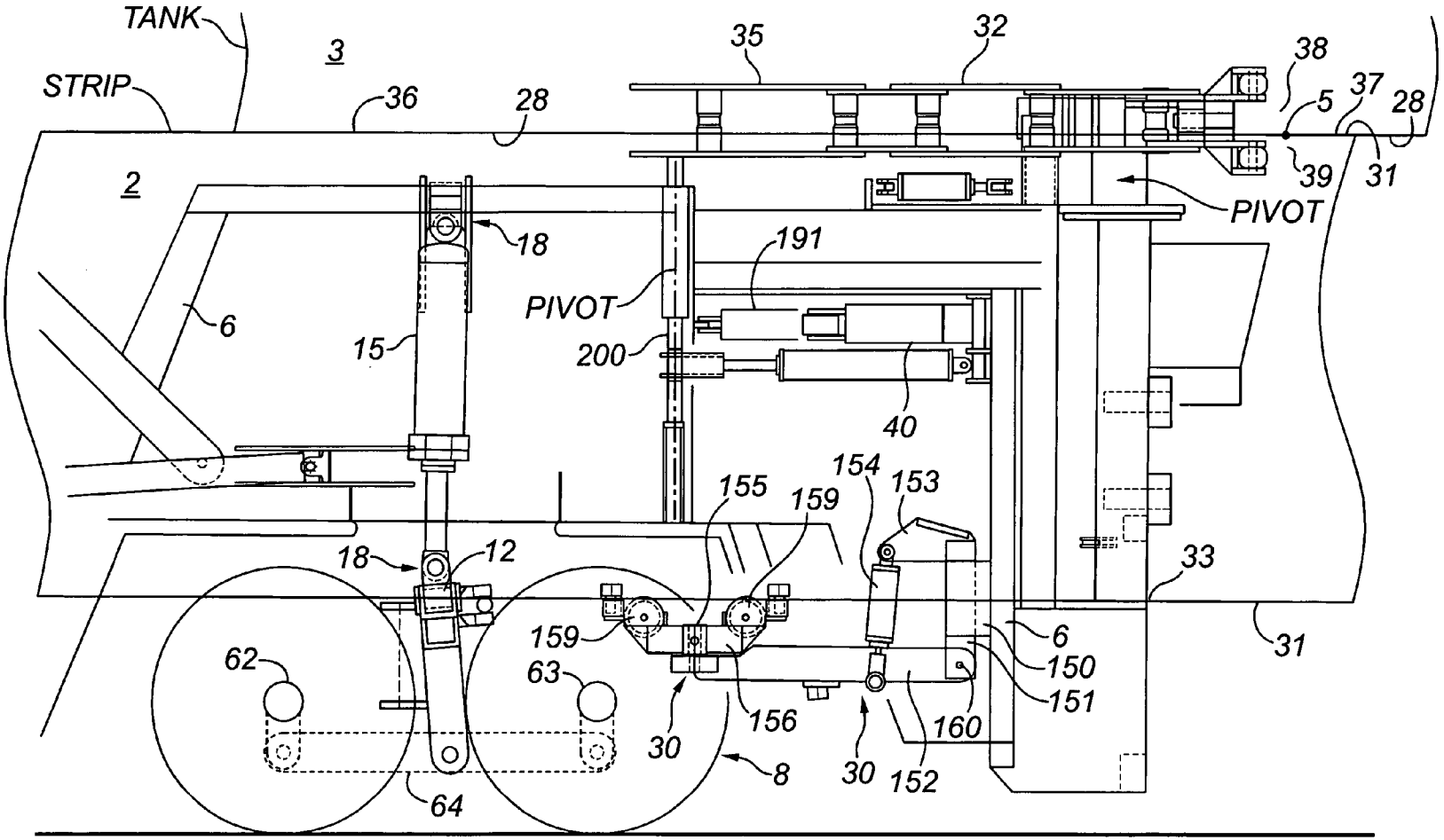
FIG. 6 is a side elevation of the rear end of the machine showing the main frame, the undercarriage assembly, the strip rear carrier roller assembly, the fitting frame assembly and part of the hi-lo assembly.
Figure 27:
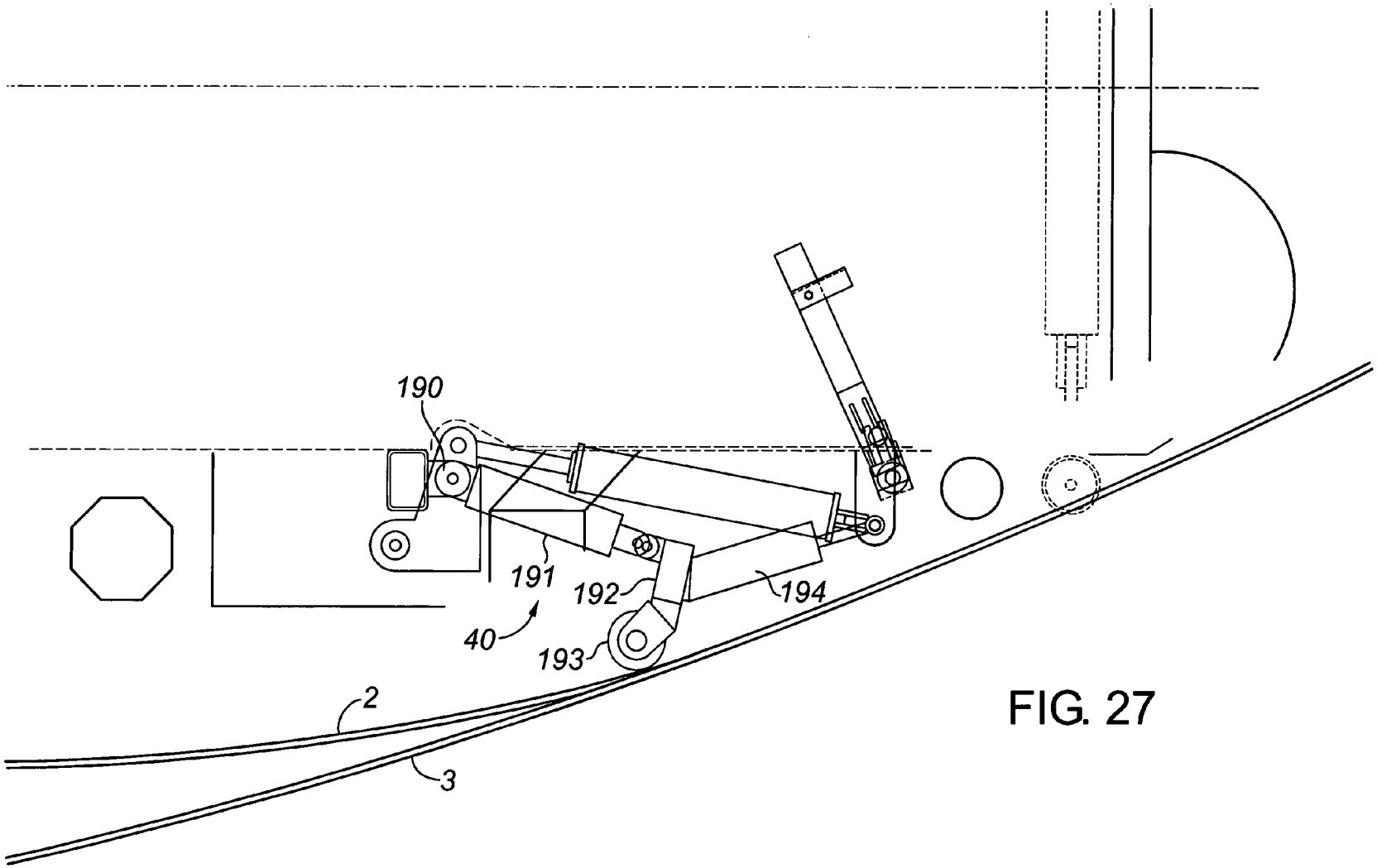
FIG. 27 is a plan view showing the inside push-out assembly.
Figure 28:
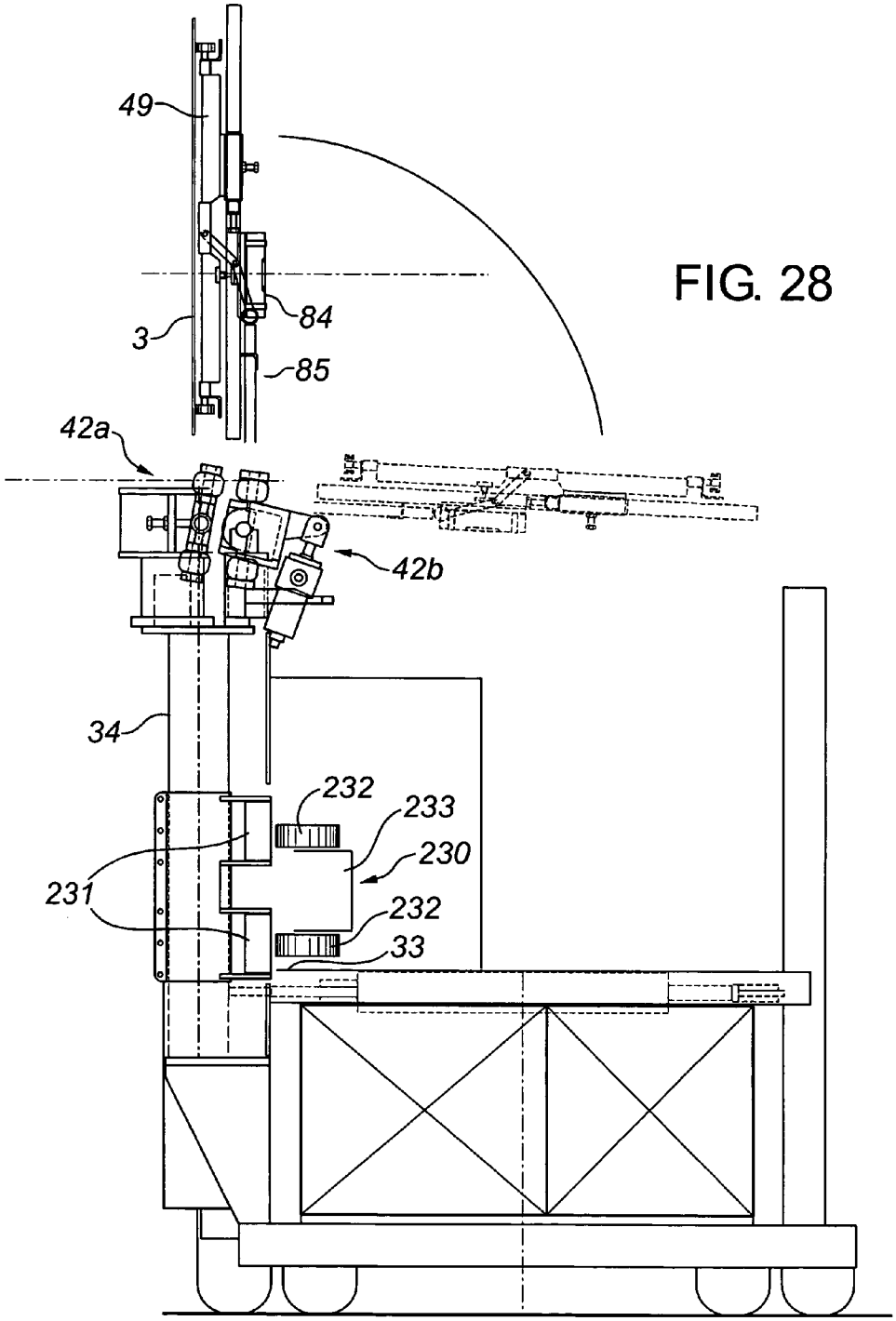
FIG. 28 is a rear view of the machine showing the strip feed roll, hi-lo and rear vertical inclinometer assemblies.

The inside push-out assembly 40 is shown in FIGS. 2, 6 and 27 and comprises a vertical shaft 190 mounted to the main frame 6. A horizontal push-out cylinder 191 is pivotally attached at one end to the shaft 190 and at the other end to one side of a bracket 192. The bracket 192 supports a vertically oriented, rotatable roller 193. The bracket 192 is also supported on its other side by an arm 194 which is pivotally attached to the main frame 6.

The roller 193 is positioned at the mid-line of the strip 2 about 6" in front of the forward end of the fitting arm 171.

The push-out cylinder 191 is controlled by a valve (not shown) which can be manually operated. At initial set-up, the push-out cylinder 191 is adjusted to position the roller 193 so that it bears against the straightened strip 2 and flexes it outwardly slightly, to influence the strip 2 to adopt a curvature substantially conforming to that of the tank wall 3.

As the operation proceeds, the operator can adjust the push-out cylinder 191 as he deems appropriate to better form the strip 2 to cause it to conform to the fitting arm 171 and the tank wall 3.

Inside Back-Up Tandem Roller Assembly

The inside back-up tandem roller assembly 53 is illustrated in FIGS. 2, 4 and 33. The assembly 53 comprises a vertical shaft 200 rotatably mounted to the main frame 6. A horizontal cylinder 201 is pivotally connected at one end by a pin and bracket assembly 202 to the main frame 6. At its other end the cylinder 201 is pivotally attached by a clevis 203 to the shaft 200. The cylinder 201 is operative to turn the shaft 200.

A support arm 204 is disengagably clamped at one end to the upper end of the shaft 200. A T-shaped member 205 is pivotally mounted by a pin 206 to the other end of the support arm 204. The T-shaped member 205 carries rotatably mounted, vertically spaced apart pairs of rollers 207 at its two ends.

At set-up, the support arm 204 can be adjusted vertically to position each pair of rollers 207 so that they bracket the joint 37 and bear against the tank wall 3 and strip 2, opposite the fitting arm 171.

In operation, the cylinder 201 can be manually actuated to turn the shaft 200 to cause the support arm 204 to bias the T-shaped member 205 outwardly, to press the strip 2 and tank wall 3 against the rollers 173 of the arcuate fitting arm 171. As a result, the strip 2 will assume the curvature of the tank wall 3 and the strip and wall edge portions 39, 38 will align in a common plane and have common radius in the vicinity of the tack point 5.

Hi-Lo Roller Assembly

The hi-lo roller assembly 42 is located immediately downstream of the rear end of the fitting arm 171. The assembly 42 comprises exterior and interior assemblies **42*a*, 42*b* which function in combination to correct minor plate misalignment at the tack point 5**.

More particularly, having reference to FIG. 33, the exterior assembly **42*a* is connected to the fitting arm 171. It comprises a shaft 210 which extends rearwardly. A sleeve 211 is concentrically and rotatably mounted on the rear end of the shaft 210. At its rear end, the sleeve 21.1 is attached to a vertical or transverse shaft 212 at the latter's mid-point. The shaft 212 carries rotatable, vertically spaced apart rollers 213. The rollers 213 bracket the joint 37 and are positioned to bear against the exterior surfaces of the tank wall 3 and strip 2. The shaft 212 and rollers 213 can rock about their central connection with the rotatable sleeve 211**.

The interior assembly **42*b* comprises a vertical shaft 214 fixed to the main frame 6. An arm 215 is pivotally mounted on a horizontal pin 216 rotatably carried by the upper end of the shaft 214. An upstanding cylinder 217 is connected between the main frame 6 and a pair of ears 218 projecting from the arm 215. The cylinder 217 can be manually actuated to turn the arm 215 about its longitudinal axis. The arm 215 is attached to a transverse shaft 219 in a T configuration. The shaft 219 carries a pair of vertically spaced apart rollers 220 at its ends. Turning the arm 215 will rock the rollers 220**.

The operator can therefore operate the cylinder 217 to bring one of the internal rollers 220 to bear against an inwardly protruding plate to displace it outwardly. This rocks the external shaft 212 and rollers 213, which act to prevent the other plate from being displaced, thereby enabling alignment to take place.

Strip Feed Roll Assembly

Figure 35:
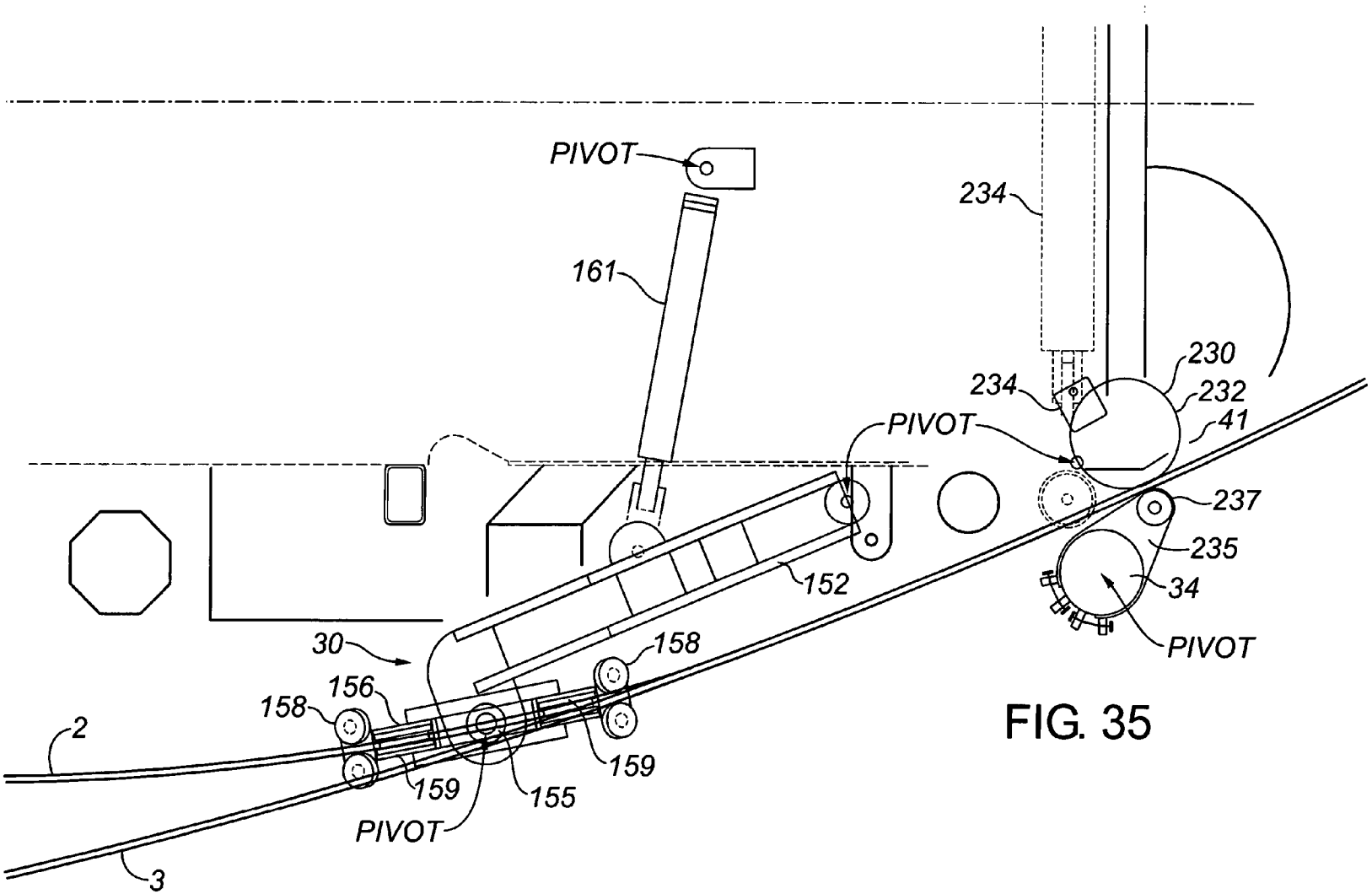
FIG. 35 is a plan view showing the inside back-up tandem roller assembly and the strip feed roll assembly.
Figure 36:
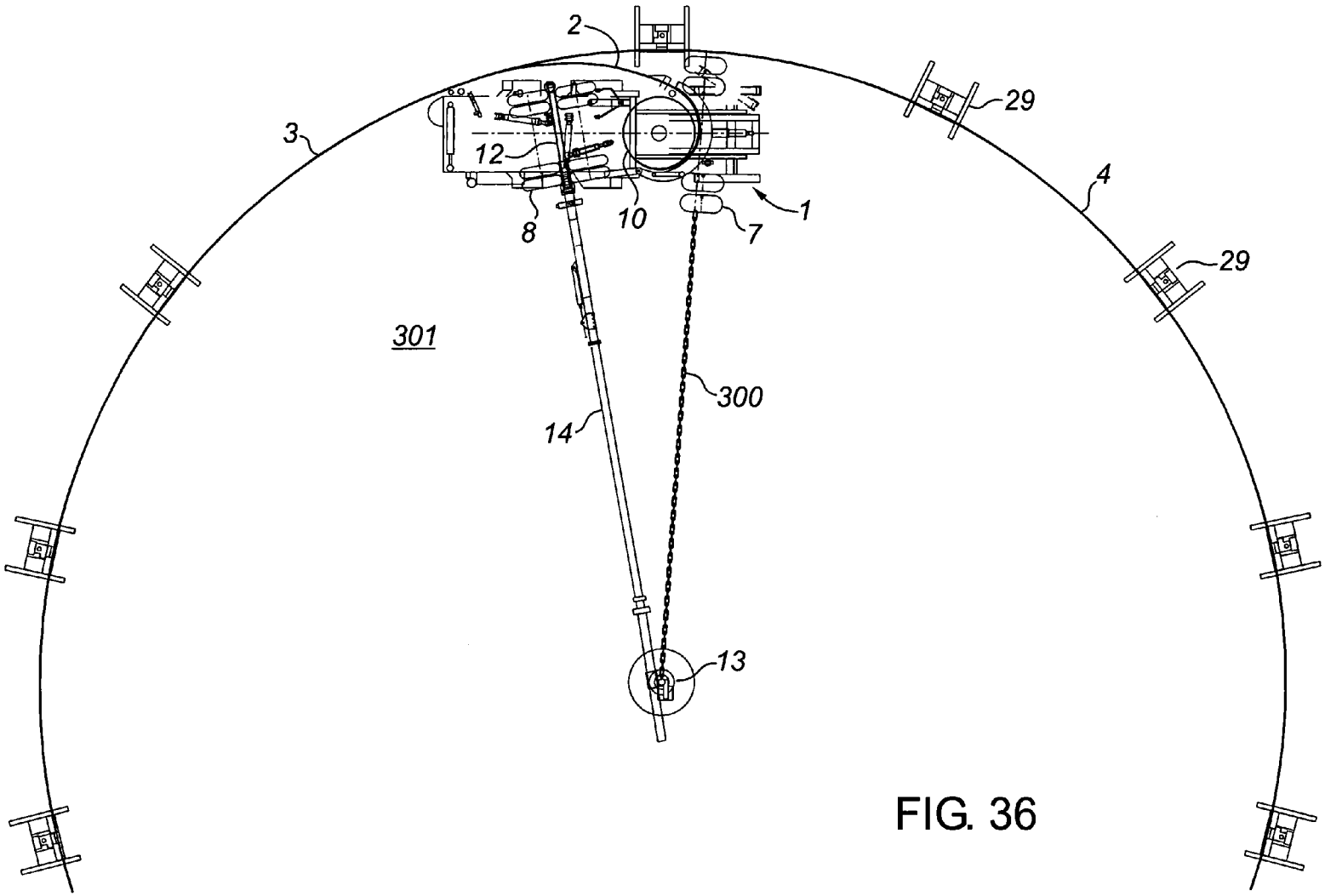
FIG. 36 is a plan view showing the tank, the jacks, the machine and the radius beam and tether.
Figure 37:
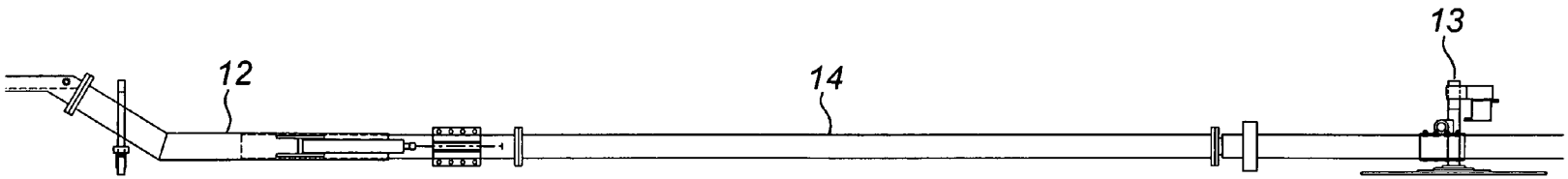
FIG. 37 is a side view of the radius beam assembly.
Figure 38:
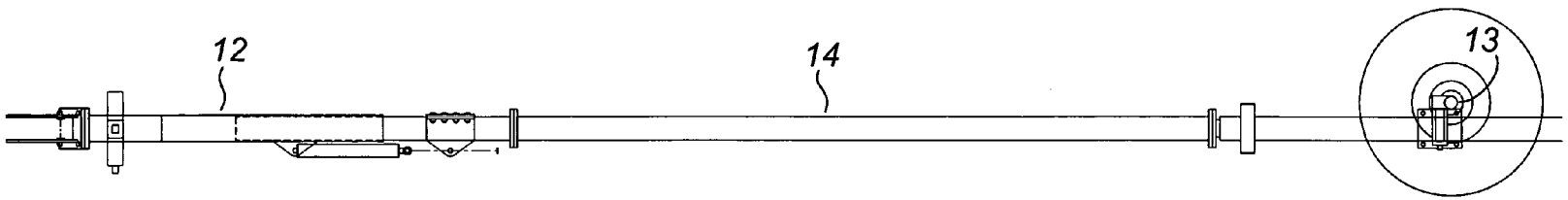
FIG. 38 is a plan view of the radius beam assembly.
Figure 39:
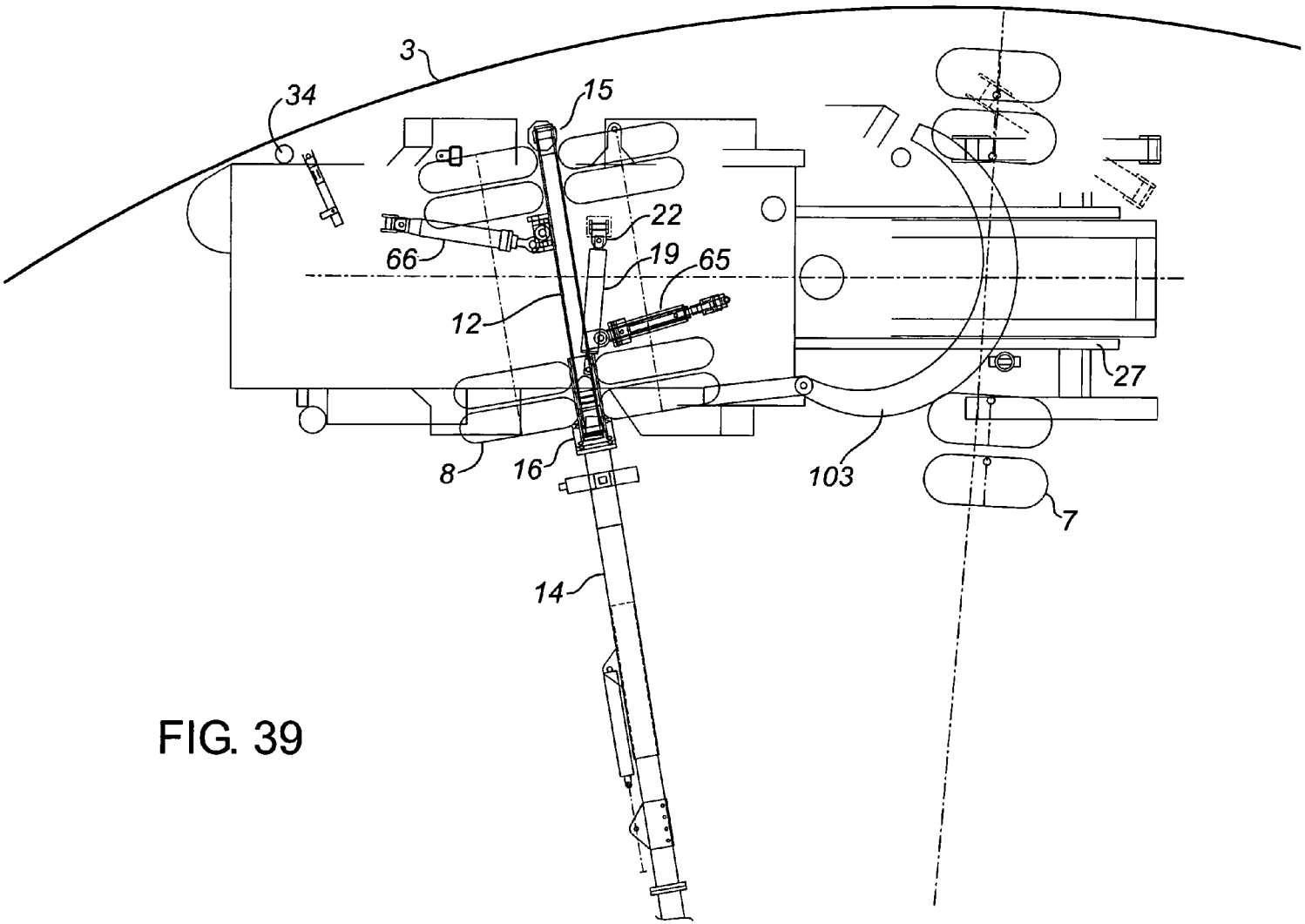
FIG. 39 is a plan view showing the radius beam connected to the machine cross-beam.

The strip feed roll assembly 41 is shown in FIGS. 29 and 35. It comprises opposed inside and outside pinch roll assemblies 230, 231. The assemblies 230, 231 engage the interior and exterior surfaces, respectively, of the strip 2, at about its mid-line. They are located at the rear end of the machine 1, just before the tack point 5. They function to pull the strip 2 through the machine 1. The position or radius of the rollers 237 can be adjusted by unclamping the sleeve 235 and rotating it about the post 170.

More particularly, the inside assembly 230 is pivotally mounted to the main frame 6, so that it can be moved in a horizontal plane, toward or away from the strip 2. The assembly 230 comprises a pair of rollers 232, mounted to and driven by a hydraulic motor 233. A manually operated cylinder 234, anchored to the main frame 6, is connected to the assembly 230 and is operative to bias the rollers 232 into or out of driving engagement with the strip 2. The outside assembly 231 comprises a sleeve 235 bolted onto the fitting frame post 170. The sleeve 235 is connected with a bracket 236 carrying a pair of vertical rollers 237. The rollers 237 are positioned opposite to the driven rollers 232 of the inside assembly 230.

In operation the machine 1 carries out the following:

The driven undercarriage assemblies 7, 8 can be maneuvered to locate the machine 1 so that its outside rear corner 33 is positioned just outside the tank wall 3. The post 34 and fitting arm 171 are positioned adjacent to and exterior of the tank wall 3. The rollers 173 of the fitting arm 171 bracket the joint 37 for a distance of about 5 feet extending forwardly from the tack point 5 and bear against the exterior surfaces of the tank wall and strip edge portions 38, 39. The fitting arm 171 therefore provides an arcuate form or anvil conforming in curvature to the tank wall 3 and backing the tank wall 3 and strip 2 at the joint 37 for 5 feet ahead of the tack point 5;

The turntable 90 can rotate to feed out strip 2 from the coil 10. The lineal advance of the strip 2 is assisted by the feed roll assembly 41, which acts to pull on the strip 2 at its mid-line in the vicinity of the tack point 5;

The C-arm 103 functions to guide and reverse the strip 2 as it leaves the coil 10, so that it enters the straightening assembly 11;

The straightening assembly rolls 107–109 straighten the strip 2 so that it substantially conforms with the curvature of the tank wall 3;

The forward carrier roller assembly 27, under the control of the laser sensor receiver 46 and forward vertical inclinometer assembly 47 and biased by the cylinders 130 and 133, functions to adjust the elevation and radius of the tank wall 3 at the front end of the machine 1 to maintain them as required;

The inside push-out assembly 40 acts to form the straightened strip 2 as required, to round it to the curvature of the tank wall 3, and to guide it into the fitting arm 171;

The inside back-up tandem roller assembly 53 acts to press both the tank wall 3 and strip 2 against the fitting arm 171 to align them and conform them with respect to radius and plumbness;

The hi-lo assembly 42 functions to remove misalignment and plate imperfections immediately in front of the tack point;

The front off-level, elevation, level and side-shift cylinders 23, 15,16 and 19 function in concert to maintain the attitude, radius and elevation of the main frame 6 as required to ensure an optimum fit-up and gap 36 at the tack point 5; and The radius beam 14 and chain 300 function to assist in maintaining the machine 1 in radius as it advances along the floor 301.

In operation the machine 1 carries out the following:

The driven undercarriage assemblies 7, 8 can be maneuvered to locate the machine 1 so that its outside rear corner 33 is positioned just outside the tank wall 3. The post 34 and fitting arm 171 are positioned adjacent to an exterior of the tank wall 3. The rollers 173 of the fitting arm 171 bracket the joint 37 for a distance of about 5 feet extending forwardly from the tack point 5 and bear against the exterior surfaces of the tank wall and strip edge portions 38, 39. The fitting arm 171 therefore provides an arcuate form or anvil conforming in curvature to the tank wall 3 and backing the tank wall 3 and strip 2 at the joint 37 for 5 feet ahead of the tack point 5;

The turntable 909 can be driven and rotate the feed out strip 2 from the coil 10. The lineal advance of the strip 2 is assisted by the feed roll assembly 41, which acts to pull on the strip 2 at its mid-line in the vicinity of the tack point 5;

The C arm 103 functions to guide and reverse the strip 2 as it leaves the coil 10, so that it enters the straightening assembly 11;

The straightening assembly rolls 107–109 straighten the strip 2 so that it substantially conforms with the curvature of the tank wall 3;

The forward carrier roller assembly 27, under the control of the laser sensor receiver 46 and forward vertical inclinometer assembly 47 and biased by the cylinders 130 and 133, functions to adjust the elevation and radius of the tank wall 3 at the front end of the machine 1 to maintain them as required;

The inside push-out assembly 40 acts to form the straightened strip 2 as required, to round it to the curvature of the tank wall 3 and to guide it into the fitting arm 171;

The inside back-up tandem roller assembly 53 acts to press both the tank wall 3 and strip 2 against the fitting arm 171 to align them and conform them with respect to curvature and plumbness;

The hi-lo assembly 42 functions to remove misalignment and plate imperfections immediately in front of the tack point;

The front off-level, elevation, level and side-shift cylinders 23, 15, 16 and 19 function in concert to maintain the attitude, radius and elevation of the main frame 6 as required to ensure an optimum fit-up and gap 36 at the tack point 5; and The radius beam 14 and chain 300 function to assist in maintaining the machine 1 in radius as it advances along the floor 301.

From the foregoing description, one skilled in the art can easily ascertain the essential characteristics of this invention and, without departing from the spirit and scope thereof, can make various changes and modifications of the invention to adapt it to various usages and conditions.

The embodiments of the invention in which an exclusive property or privilege is claimed are defined as follows:

1. A method for finely adjusting, at a tack point, the width of a gap between a bottom edge of a steel side wall of an elevated cylindrical tank and a top edge of a steel strip being fed from a coil being transported by a machine moving circularly within the tank, said edges forming a joint line, the strip already having been welded along part of its length to the tank wall along the joint line behind the tack point, comprising:

monitoring the plumbness, elevation and levelness of the tank wall;

responsive to such monitoring, manipulating and positioning the tank wall so that it is plumb and in plane at a pre-determined elevation at the tack point;

supplying, manipulating and positioning the strip so that it aligns with and assumes the curvature of the tank wall at the tack point, with the strip and wall edges being separated to provide the gap at the tack point;

monitoring the width of the gap; and, responsive to such gap width monitoring, radially moving the bottom of the strip as required to thereby adjust the plumbness of the strip and effect an adjustment of the gap width at the tack point to bring it to a pre-determined optimum width for welding.

2. The method as set forth in claim 1 comprising:

supporting the outside surfaces of the tank wall and strip above and below the joint line in the vicinity of the tack point with external arcuate fitting frame means conforming to the curvature of the tank wall; and internally pressing the wall and strip against the fitting frame means to bring them into corresponding alignment, curvature and plumbness at the tack point.

3. A method for controlling the width of a gap, at a tack point, between a bottom edge of a steel side wall of an elevated cylindrical tank and a top edge of a steel strip being fed from a coil being transported by a machine moving circularly within the tank said edges forming a joint line the strip already having been welded along part of its length to the tank wall along the joint line behind the tack point, comprising:

mechanically monitoring the plumbness, elevation and levelness of the tank wall;

responsive to such monitoring, manipulating and positioning the tank wall so that it is plumb and in plane at a pre-determined elevation at the tack point;

supplying, manipulating and positioning the strip so that it aligns with and assumes the curvature of the tank wall at the tack point, with the strip and wall edges being separated to provide the gap at the tack point;

mechanically monitoring the width of the gap at the tack point;

holding and supporting the strip at its bottom edge; and responsive to such gap width monitoring, radially moving the bottom of the strip through a relatively coarse travel to thereby adjust the gap width at the tack point by a relatively fine amount to bring it to a pre-determined optimum width for welding.

4. A machine for supplying, manipulating and positioning steel strip to locate the strip's upper edge in spaced relationship below the lower edge of an elevated cylindrical tank wall, to which the strip is already welded along part of its length, to form a gap at a joint line and at a tack point, which gap has a width optimal for welding of the strip to the wall, comprising:

a generally horizontal main frame;

first means for conveying the main frame and positioning it as required;

second means, supporting the main frame on the conveying means, for separately adjusting the elevation, attitude and radius of the main frame;

third means for carrying a coil of steel strip on the main frame and dispensing and straightening strip so that it substantially conforms with the curvature of the tank wall;

fourth means, connected with the main frame, for supporting and holding the straightened strip at its lower edge, so that the strip is substantially upright relative to the main frame;

fifth means, connected with the main frame, for externally supporting the outside surfaces of the strip and tank wall above and below the joint line in the vicinity of the tack point; and sixth means, carried by the main frame, for Dressing the strip and tank wall outwardly against the fifth means;

whereby the attitude, elevation and radius of the main frame may be adjusted to vary the width of the gap between the tank wall and strip at the tack point;

and whereby the strip and tank wall may be pressed outwardly against the fifth means to align their top and bottom edges, respectively, for welding.

5. The machine as set forth in claim 4 wherein:

the fifth means comprises a fitting frame curved to conform with the curvature of the tank wall.

6. The machine as set forth in claim 4 or 5 wherein:

the fourth means is rigidly connected with the main frame and is operative to hold the strip at a pre-determined set angle relative to the plane of the main frame, so that a change in side to side level of the main frame will vary the plumbness of the strip.

7. The machine as set forth in claim 4 or 5 comprising:

seventh means for mechanically monitoring the plumbness and elevation of the tank wall adjacent the tack point and activating the second means to adjust the plumbness and elevation of the tank wall so that it is plumb and in plane; and eighth means for mechanically monitoring the width of the gap and activating the second means as required to adjust the width of the gap to a pre-determined value.

8. The machine as set forth in claim 4 or 5 wherein:

the fourth means is rigidly connected with the main frame and is operative to hold the strip at a pre-determined set angle relative to the plane of the main frame, so that a change in side to side level of the main frame will vary the plumbness of the strip; and further comprising seventh means for mechanically monitoring the plumbness and elevation of the tank wall and activating the second means as required to adjust the plumbness and elevation of the tank wall are required; and eighth means for mechanically monitoring the width of the gap and activating the second means as required to adjust the width of the gap to a pre-determined value.

* * * * *

UNITED STATES PATENT AND TRADEMARK OFFICE

CERTIFICATE OF CORRECTION

PATENT NO. : 7,086,576 B2
APPLICATION NO. : 10/686837
DATED : August 8, 2006
INVENTOR(S) : Morrison It is certified that error appears in the above-identified patent and that said Letters Patent is hereby corrected as shown below:

Column 21
Line 10, after "tank", insert --,--;
Line 10, after "line", insert --,--.

Column 22
Line 5, delete "Dressing" and insert therefor --pressing--.

Signed and Sealed this

Tenth Day of October, 2006

JON W. DUDAS
*Director of the United States Patent and Trademark Office*